US008831447B2

(12) United States Patent
Suzuki

(10) Patent No.: US 8,831,447 B2
(45) Date of Patent: Sep. 9, 2014

(54) PRINT CONTROL APPARATUS AND CONTROL METHOD THEREOF

(75) Inventor: Katsunari Suzuki, Yokohama (JP)

(73) Assignee: Canon Kabushiki Kaisha (JP)

( * ) Notice: Subject to any disclaimer, the term of this patent is extended or adjusted under 35 U.S.C. 154(b) by 190 days.

(21) Appl. No.: 13/447,575

(22) Filed: Apr. 16, 2012

(65) Prior Publication Data

US 2012/0263483 A1 Oct. 18, 2012

(30) Foreign Application Priority Data

Apr. 18, 2011 (JP) ..... 2011-092476

(51) Int. Cl.
*G03G 15/00* (2006.01)

(52) U.S. Cl.
CPC ..... *G03G 15/55* (2013.01); *G03G 15/5062* (2013.01)
USPC ..... 399/43

(58) Field of Classification Search
CPC ..... G03G 15/5062
USPC ..... 399/43
See application file for complete search history.

(56) References Cited

U.S. PATENT DOCUMENTS 5,532,791 A * 7/1996 Takahashi et al. ..... 399/18
8,049,911 B2 * 11/2011 Nakagawa ..... 358/1.14

FOREIGN PATENT DOCUMENTS

JP 2010042601 A 2/2010

OTHER PUBLICATIONS

Machine translation of JP 2010-042601 A , publication date: Feb. 25, 2010.*

* cited by examiner

*Primary Examiner* — Walter L Lindsay, Jr.
*Assistant Examiner* — Frederick Wenderoth
(74) *Attorney, Agent, or Firm* — Rossi, Kimms & McDowell LLP

(57) ABSTRACT

A print control apparatus that controls a printing unit is provided. A determination unit determines print quality of a print image printed by the printing unit. A first counting unit counts the number of pages of each of sets whose print quality is determined by the determination unit not to satisfy a predetermined criterion. A second counting unit counts the number of same pages of the sets whose prnt quality is determined by the determination unit not to satisfy a predetermined criterion. A control unit stops printing by the printing unit if a count value counted by the first counting unit reaches a first predetermined value and stops printing by the printing unit if a count value counted by the second counting unit reaches a second predetermined value.

18 Claims, 18 Drawing Sheets

PRINT CONTROL APPARATUS AND CONTROL METHOD THEREOF

BACKGROUND OF THE INVENTION

1. Field of the Invention

The present invention relates to a print control apparatus that controls printing by scanning an image on printed paper and determining its print quality, and a control method that controls the print control apparatus.

2. Description of the Related Art

Conventionally, in printing and binding systems including print-on-demand (POD) machines and the like, the quality of an image on printed paper is recognized (print quality inspection (hereinafter, referred to as "inspection")), and, if it is determined that the quality is not a desired quality, the printing is temporarily stopped (see Japanese Patent Laid-Open No. 2010-42601, for example).

When it is determined in the inspection that a predetermined criterion is not satisfied, and the printing process is stopped, downtime occurs during that time and productivity becomes poor even if the printing process can be resumed later.

Furthermore, even in a configuration in which, in order to improve the productivity, the printing process is continued by outputting to another printing unit image data printed on paper whose print quality is determined not to satisfy a predetermined criterion, if it is frequently determined that the predetermined criterion is not satisfied, a problem occurs in which paper is wasted.

Furthermore, as one of factors that lead to the determination that a predetermined criterion in inspection is not satisfied, there is an occurrence in which dust is scanned because inspection is performed with dust being present on paper, but it seems that the frequency of such an occurrence is only a few percent or less.

Meanwhile, in POD machines, it is common to repeatedly print original image data on a plurality of sets of paper. At that time, there may be a case in which, due to the original image data, the print quality is frequently determined not to satisfy a predetermined criterion in the same pages. Furthermore, there may be a case in which, due to the printer, the print quality is successively determined not to satisfy a predetermined criterion in successive pages. It seems that the frequency of such determination is sufficiently larger than that of the above-described case where dust is scanned. If the frequency of determination that a predetermined criterion is not satisfied increases when performing printing of a plurality of sets, sets of paper include pages whose print quality is determined not to satisfy a predetermined criterion, that is, include defective pages, which leads to problems in which productivity becomes poor and paper resources are wasted.

SUMMARY OF THE INVENTION

The present invention solves the above-described problems in conventional techniques.

An aspect of the invention of the present application is to stop the printing operation if a predetermined number of pages whose print quality does not satisfy a predetermined criterion appear.

Furthermore, an aspect of the invention of the present application is to provide a technique for suppressing a decline in productivity and for preventing waste of paper resources by stopping the printing process if the frequency of pages whose print quality does not satisfy a predetermined criterion exceeds a predetermined value.

According to one aspect of the present invention, a print control apparatus that controls a printing unit is provided. The print control apparatus includes a determination unit configured to determine print quality of a print image printed by the printing unit, a first counting unit configured to count the number of pages of each of a plurality of sets whose print quality is determined by the determination unit not to satisfy a predetermined criterion, a second counting unit configured to count the number of same pages of the plurality of sets whose prnt quality is determined by the determination unit not to satisfy a predetermined criterion, and a control unit configured to stop printing by the printing unit in a case where a count value counted by the first counting unit reaches a first predetermined value and to stop printing by the printing unit in a case where a count value counted by the second counting unit reaches a second predetermined value.

According to the present invention, it is possible to stop the printing operation if a predetermined number of pages whose print quality does not satisfy a predetermined criterion appear.

Furthermore, it is possible to suppress a decline in productivity and to prevent waste of paper resources by stopping the printing process if the frequency of pages whose print quality does not satisfy a predetermined criterion exceeds a predetermined value.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

Hereinafter, an embodiment of the present invention will be described in detail with reference to the appended drawings. Note that the following embodiment does not limit the present invention according to the scope of the invention, and all combinations of features described in this embodiment are not essential for the solving means of the invention.

Figure 1:
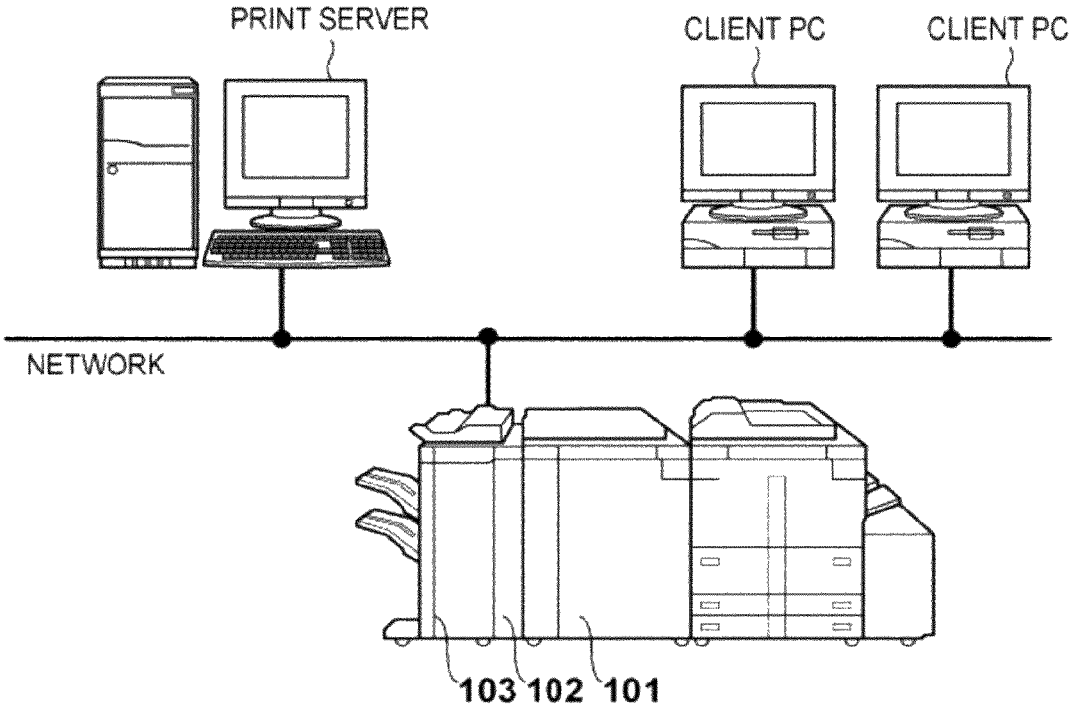
FIG. 1 is a view showing an exemplary system configuration including an inspection device according to an embodiment of the present invention.

FIG. 1 is a view showing an exemplary system configuration including an inspection device according to an embodiment of the present invention.

An image forming apparatus (printer) 101 performs printing by processing various types of input data. Furthermore, an inspection device 102 receives paper printed by the image forming apparatus 101 and inspects the printed state. A finisher 103 receives the printed paper inspected by the inspection device 102 and performs finishing processes. The image forming apparatus 101 is connected via a network to an external print server and client PCs. One inspection device 102 is connected via a communication cable to one image forming apparatus 101. One finisher 103 is connected via another communication cable to one image forming apparatus 101. This embodiment shows an example of an inline inspection machine that continuously performs formation (printing) of an image, inspection of the printed image, and finishing.

Figure 2:
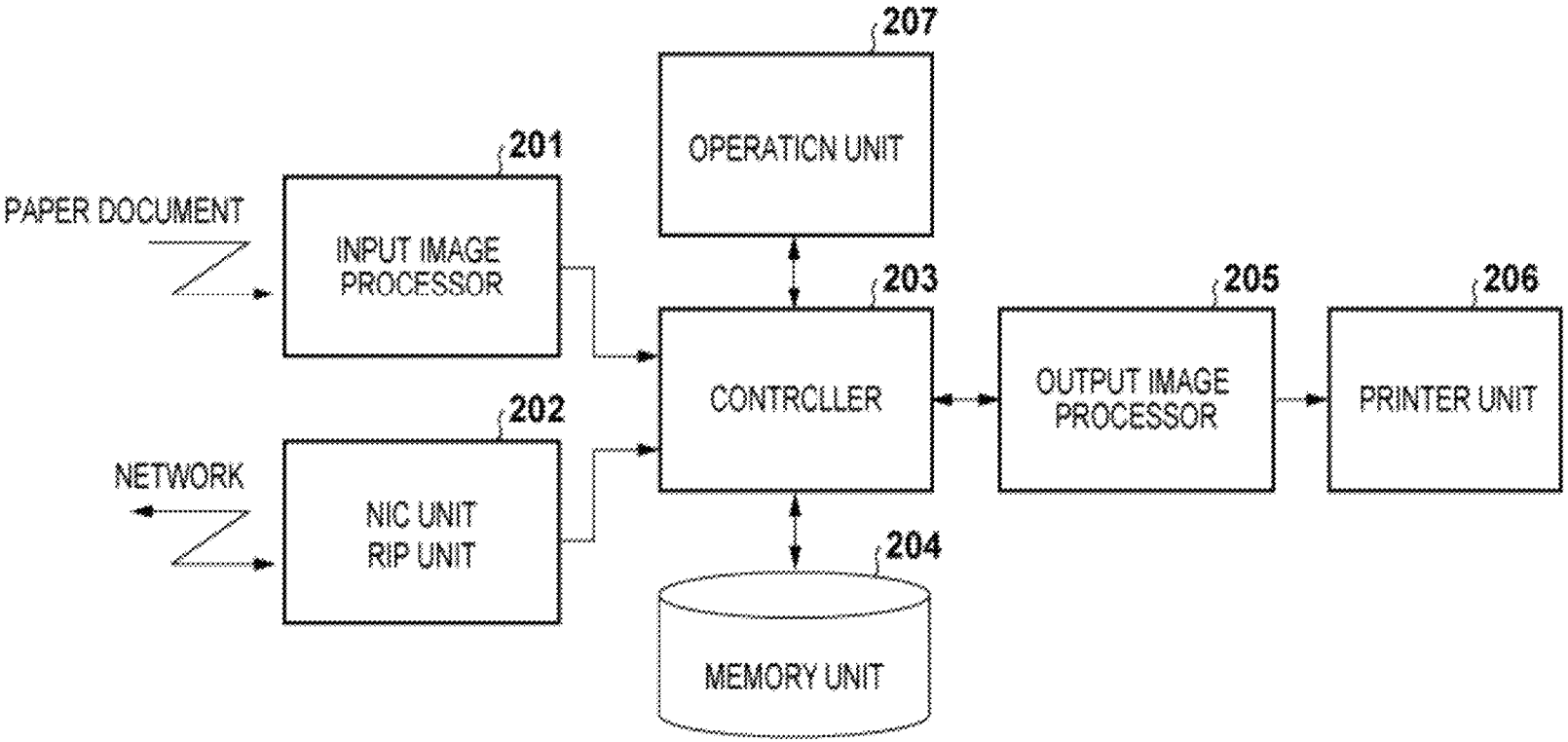
FIG. 2 is a block diagram illustrating the configuration of an image forming apparatus 101 according to the embodiment.

FIG. 2 is a block diagram illustrating the configuration of the image forming apparatus 101 according to the embodiment.

An input image processor 201 scans a paper document or the like using an image scanning device such as a scanner, generates image data based on signals of the scanned image, and performs image processes on the image data. An NIC unit 202 passes image data (mainly PDL data) input via a network to an RIP unit, and transmits image data or apparatus information inside the image forming apparatus 101 via a network to the outside. The RIP unit interprets the input PDL data and performs RIP development.

The image data input from the NIC unit 202 or the input image processor 201 is transmitted to a controller 203. The controller 203 plays a role in controlling data that is to be input or output. Furthermore, the image data input to the controller 203 is temporarily stored in a memory unit 204. The memory unit 204 includes, for example, a hard disk or the like, and is read as necessary. An output image processor 205 performs image processes for printing image data, and the image data after the image processes is transmitted to a printer unit 206 and printed. The printer unit 206 feeds paper, and sequentially prints images on the paper based on the image data supplied from the output image processor 205. Moreover, an operation unit 207 accepts various operation instructions from a user, or displays messages and the like to the user.

Figure 3:
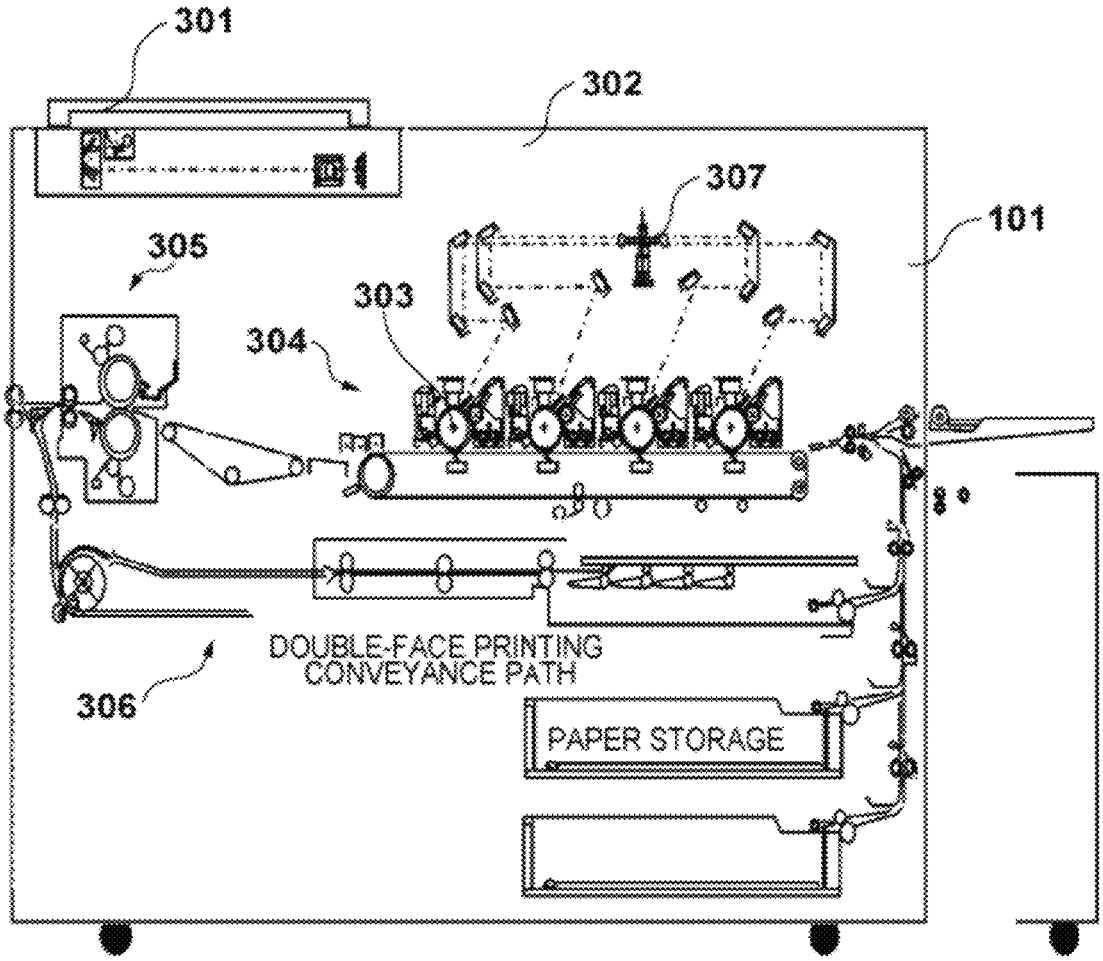
FIG. 3 is a cross-sectional view showing the configuration of a printer unit of the image forming apparatus according to the embodiment.

FIG. 3 is a cross-sectional view showing the configuration of the printer unit 206 of the image forming apparatus 101 according to the embodiment.

The image forming apparatus 101 has a scanner unit 301, a laser exposure unit 302, photosensitive drums 303, an image forming unit 304, a fixing unit 305, a feed/conveyance unit 306, and a printer controller (not shown) that controls these constituent elements. The scanner unit 301 optically scans an image on a document placed on a document stage by illuminating the document, and generates image data by converting the image into electrical signals. In the laser exposure unit 302, beams such as laser beams modulated according to the image data are incident on a rotating polygon mirror 307 that is rotating at a constant angular velocity, and reflected scanning light reflected therefrom illuminates the photosensitive drums 303. In the image forming unit 304, the photosensitive drums 303 are rotationally driven and charged by a charger, and latent images formed by the laser exposure unit 302 on the photosensitive drums 303 are developed with toner. This function is realized by providing four development units (development stations) for a series of electrophotographic processing that transfers the toner images to paper, and recovers a slight amount of toner that has not been transferred at that time and is left on the photosensitive drums 303.

The four development units arranged in order of cyan (C), magenta (M), yellow (Y), and then black (K) sequentially perform image forming operations for magenta, yellow, and then black, when predetermined periods of time have elapsed after the start of image formation by the cyan station. With this timing control, a full-color toner image is transferred to paper without color drift. Although a color printer is assumed in this embodiment, the present invention is not limited to this, and only a black development unit is mounted in the case of a monochrome printer.

The fixing unit 305 is configured by a combination of rollers and a belt, has a built-in heat source such as a halogen heater, and applies heat and pressure to melt and fix toner on paper to which the toner image has been transferred by the image forming unit 304. The feed/conveyance unit 306 has one or more paper storages typified by paper cassettes or paper decks, and, in response to instructions from the printer controller, separates one sheet from a plurality of sheets of paper accommodated in the paper storages and conveys the sheet to the image forming unit 304 and the fixing unit 305. While the paper is being conveyed, toner images of the respective colors are transferred by the above-described development stations, and, thus, a full-color toner image is formed on the paper in the end. Furthermore, when forming images on both faces of paper, control is performed such that the paper that has passed through the fixing unit 305 is conveyed onto a double-face printing conveyance path that leads again to the image forming unit 304. Here, the printer controller communicates with the controller 203 that controls the entire image forming apparatus 101, and performs control in response to instructions from the controller. Furthermore, instructions are given such that, while the states of the scanner unit, the laser exposure unit, the image forming unit, the fixing unit, the feed/conveyance unit are being managed, all units can smoothly operate in harmony with each other.

Figure 4A:
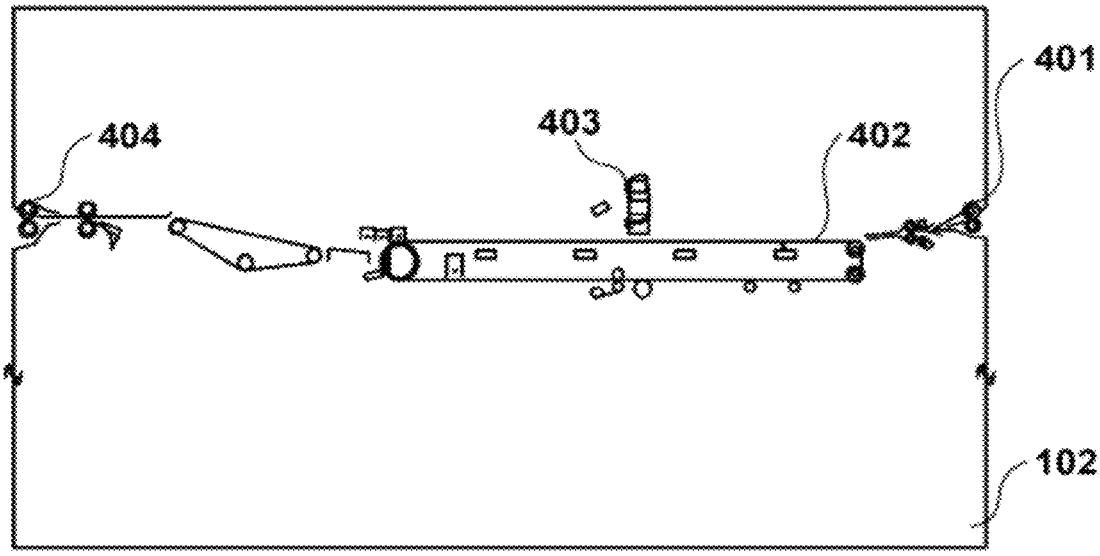
FIGS. 4A and 4B are views illustrating the configuration of the inspection device according to the embodiment.
Figure 4B:
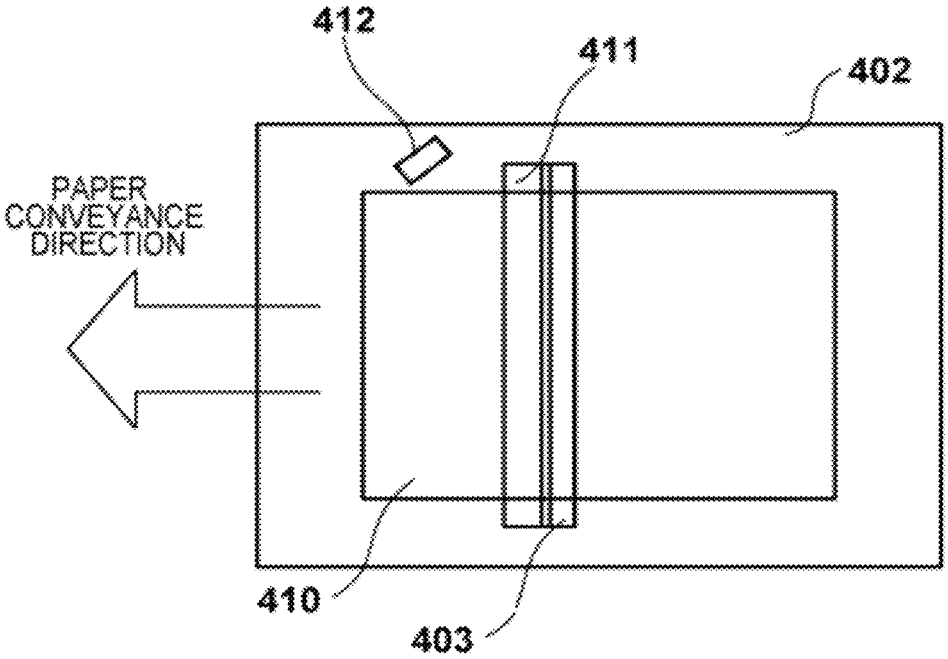

FIGS. 4A and 4B are views illustrating the configuration of the inspection device 102 according to the embodiment.

FIG. 4A is a view illustrating the schematic configuration of the inspection device 102, where printed paper (hereinafter, simply referred to as "paper") that has been printed in the image forming apparatus 101 is drawn into the inspection device 102 by paper feed rollers 401. Subsequently, while the paper is being conveyed along a conveyance belt 402, an image on the paper is scanned by a sensor 403 positioned above the conveyance belt 402, and the quality of the image is inspected. Results of this inspection are transmitted to the finisher 103. After the inspection is performed, the paper is discharged by the rotation of paper discharge rollers 404. Although not shown in this example, the sensor 403 may have a structure in which scanning can be performed also from below the conveyance belt 402 such that paper whose both faces have been printed can be dealt with.

FIG. 4B is a top view of part of the conveyance belt 402 viewed from above, where the sensor 403 is a line sensor that scans in the unit of lines an image on the entire face of paper 410 conveyed as shown in the drawing. An illuminating unit 411 illuminates the paper from above during the scanning by the sensor 403. A skew-detection illuminating unit 412 is used to detect whether or not paper is skewed with respect to the conveyance direction when the paper is being conveyed along the conveyance belt 402. In this example, the paper 410 that is being conveyed is illuminated with light from the oblique direction, and an image of a shadow from an edge of the paper 410 is scanned by the sensor 403 for skew detection. Although the image of the shadow from the edge of the paper is scanned by the sensor 403 in this embodiment, a configuration may be adopted in which a scanning sensor other than the sensor 403 is used.

Figure 5:
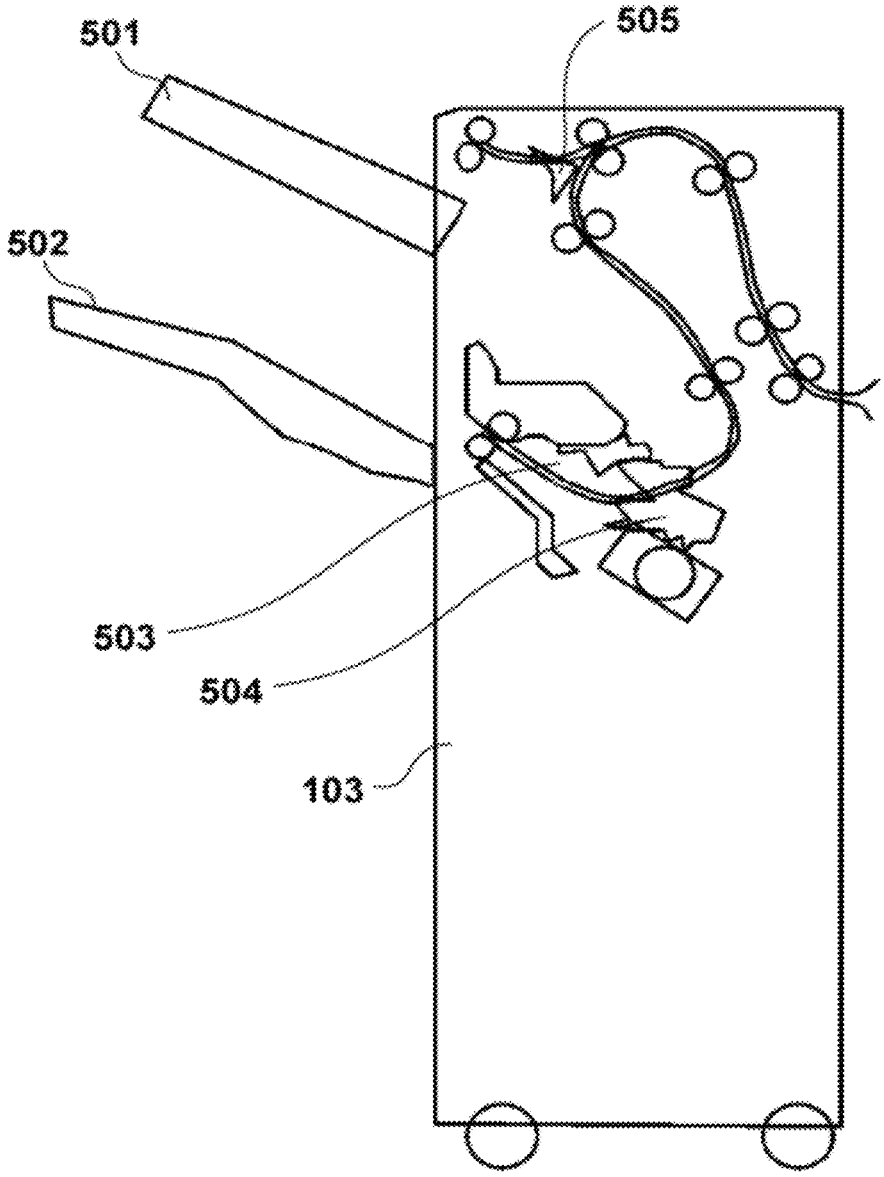
FIG. 5 is a cross-sectional view showing an exemplary configuration of a finisher according to the embodiment.

FIG. 5 is a cross-sectional view showing an exemplary configuration of the finisher 103 according to the embodiment.

The paper discharged from the inspection device 102 enters the finisher 103. The finisher 103 includes an escape tray 501 and an output tray 502, and the paper is discharged after the conveyance paths are switched according to results of the inspection by the inspection device 102. When a staple mode is set in the currently performed job, control is performed such that the paper is discharged to the output tray 502. At that time, before the paper is discharged to the output tray 502, the paper is sequentially stocked for each job in a processing tray 503 inside the finisher 103, and bound by a stapler 504 on the processing tray 503, and, then, the stapled paper bundle is discharged to the output tray 502. A conveyance path switching unit 505 switches paper conveyance paths according to results of the inspection by the inspection device 102. When conveyance paths are switched in this manner, the paper can be discharged to the escape tray 501 or the output tray 502.

Figure 6:
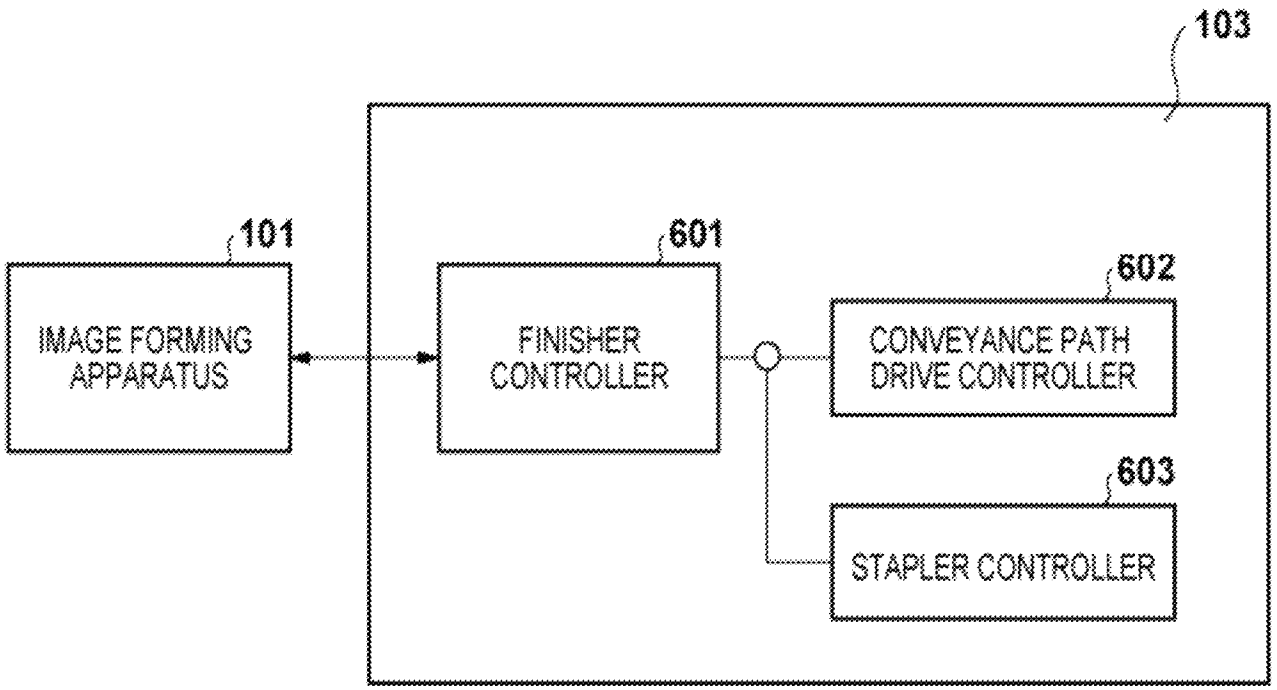
FIG. 6 is a block diagram illustrating the schematic configuration of a control system of the finisher 103.

FIG. 6 is a block diagram illustrating the schematic configuration of a control system of the finisher 103.

The controller 203 of the image forming apparatus 101 and a finisher controller 601 of the finisher 103 are connected to each other via a dedicated communication line. The finisher controller 601 receives finisher setting information according to the job from the image forming apparatus 101, and communicates with a controller (not shown) that controls the functions of the finisher 103 based on the received setting information. A conveyance path drive controller 602 guides the paper to various finishing units based on job control information transmitted from the finisher controller 601. For example, when stapling is required, the finisher controller 601 communicates with a stapler controller 603, and receives status information of the stapler controller 603. Furthermore, the job control information is transmitted to the stapler controller 603, and control is performed such that a stapler operation according to the job content is performed.

Figure 7:
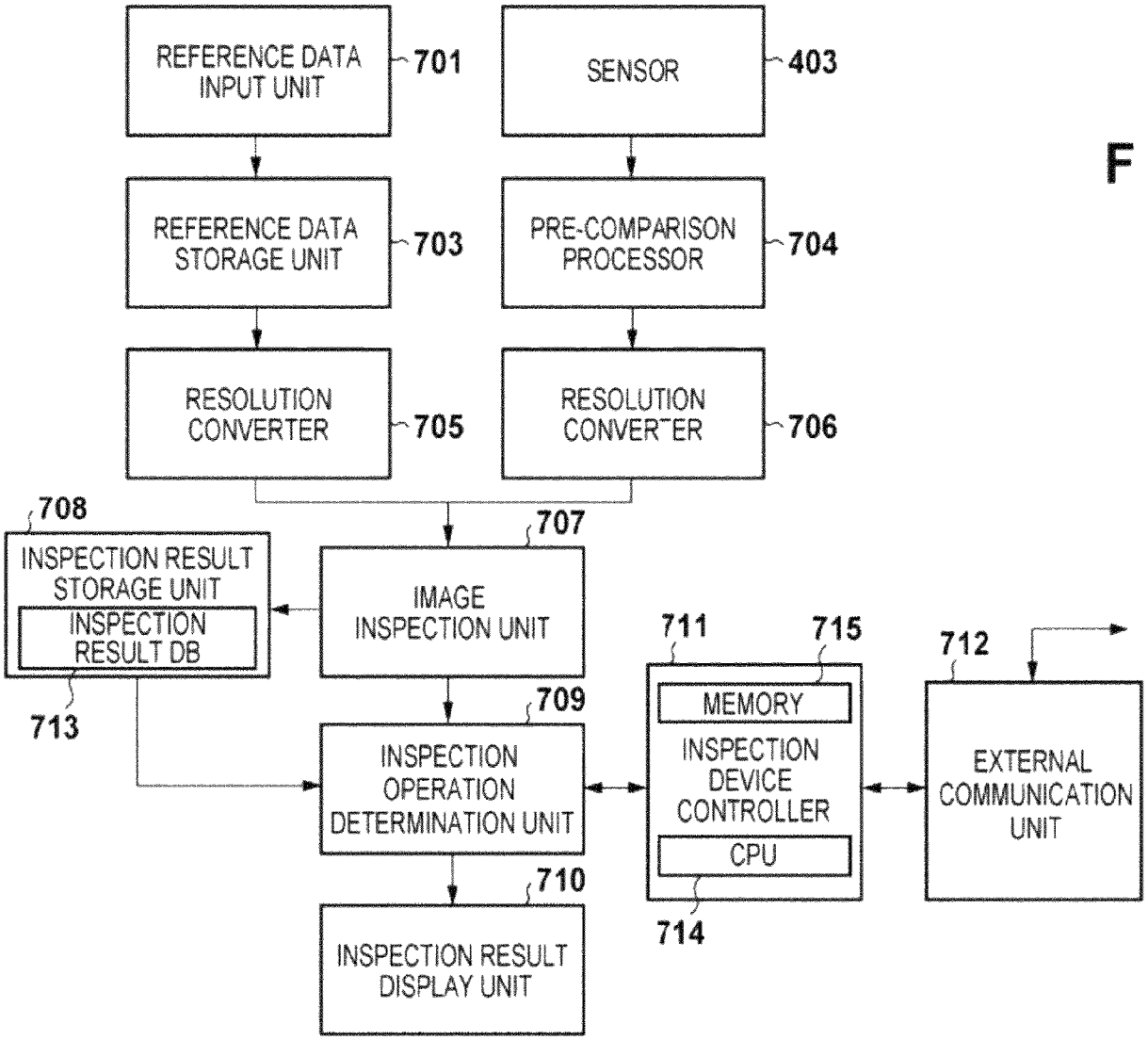
FIG. 7 is a block diagram showing the electrical processing flow in the inspection device according to the embodiment.

FIG. 7 is a diagram showing the electrical processing flow in the inspection device 102 according to the embodiment.

The image on the paper scanned by the sensor 403 is converted into electrical signals, and subjected to a pre-comparison correction process such as paper skew correction by a pre-comparison processor 704. This paper skew correction process is performed as follows. Paper that has been drawn into the inspection device 102 and conveyed along the conveyance belt 402 is illuminated by the skew-detection illuminating unit 412, a shadow of an edge of the paper formed at that time is scanned by the sensor 403, and a difference with respect to a predetermined angle is detected.

Figure 8A:
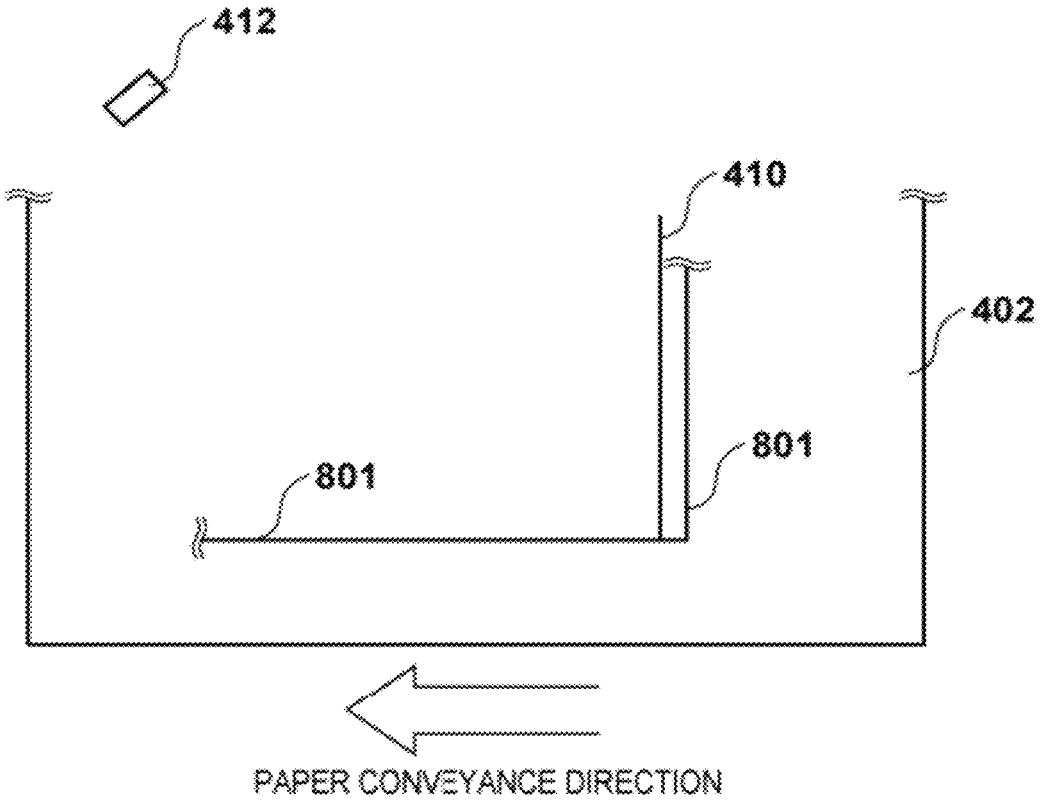
FIGS. 8A and 8B are views illustrating paper skew detection.
Figure 8B:
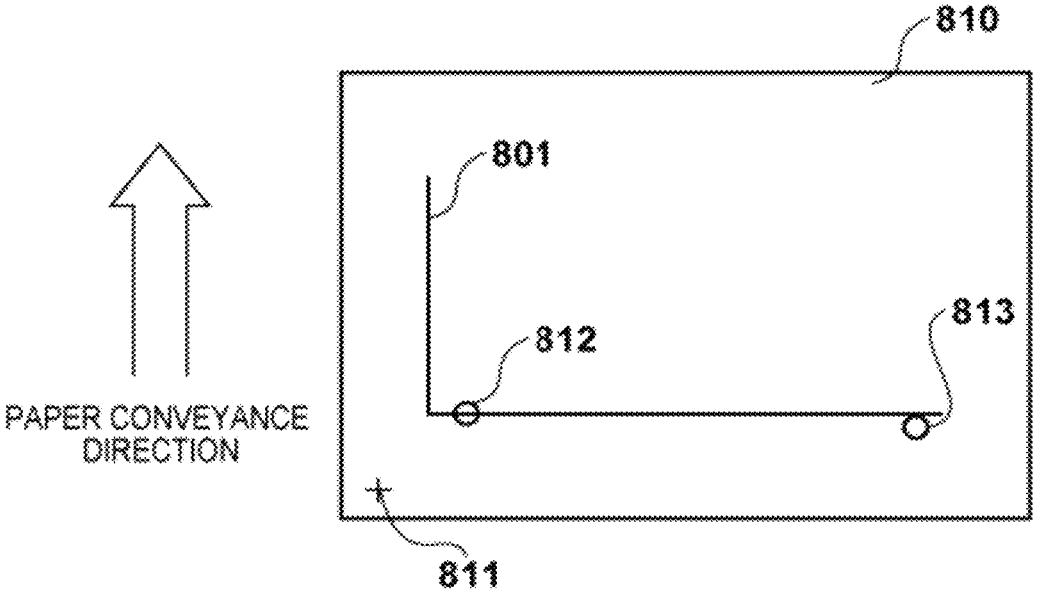

FIGS. 8A and 8B are views illustrating paper skew detection.

FIG. 8A is a view illustrating paper skew detection and inspection principle. The paper 410 that is being conveyed along the conveyance belt 402 is illuminated with light from the skew-detection illuminating unit 412 that is disposed at an angle with respect to the paper conveyance direction and above the conveyance belt 402. With this illumination, a paper edge shadow 801 is formed at the trailing edge of the paper 410. The paper edge shadow 801 is scanned by the sensor 403. The pre-comparison processor 704 performs processes such as binarization and edge detection on an image of the shadow scanned in this manner, thereby detecting skew of the shadow. At that time, the paper edge shadow 801 used for skew detection may be a shadow in the paper conveyance direction or may be a shadow in a direction orthogonal to the paper conveyance direction, or may be an average of both of the shadows.

Regarding skew detection, for example, when an image obtained by performing processes such as binarization and edge detection on image data scanned by the sensor 403 is as shown in FIG. 8B, criterion coordinates 811 are set. Next, predetermined initial point coordinates 812 and predetermined terminal point coordinates 813 are set on the image of the paper edge shadow 801. Then, relative coordinates of the criterion coordinates 811 and these coordinates are respectively obtained.

If the criterion coordinates 811 are (0,0), the initial point coordinates 812 are (300,245), the terminal point coordinates 813 are (235,3885), skew θ (degrees) between the initial point coordinates 812 and the terminal point coordinates 813 is obtained as:

$$\theta=\tan^{-1}((235-300)/(3885-245))=-1.023 \text{ (degrees)}.$$

Accordingly, it is detected that the paper 410 is skewed by 1.023 degrees in the clockwise direction with respect to the paper conveyance direction.

Based on information on the thus detected skew angle and skew rotational direction, the pre-comparison processor 704 performs a rotating process on the image data scanned by the sensor 403, and obtains image data in which the paper skew has been corrected.

After the pre-comparison processor 704 performs the pre-comparison correction process, the corrected image data is transmitted to a resolution converter 706. Meanwhile, reference data with which comparison is to be performed is input from a reference data input unit 701 and stored in a reference data storage unit 703. Here, the reference data may be input from the image forming apparatus 101 via a network, or may be directly retrieved from any retrieving interface mounted on the inspection device 102. The reference data and the scanned image data are respectively converted by a resolution converter 705 and the resolution converter 706 such that they have similar resolutions (e.g., 300 dpi) and thus can be compared with each other, and are transmitted to an image inspection unit 707.

The image inspection unit 707 compares the scanned image data input from the resolution converter 706 and the reference data input from the resolution converter 705, and determines whether or not the print image quality satisfies a predetermined criterion. In this example, a state in which the image quality satisfies a predetermined criterion is referred to as "OK" and a state in which the image quality does not satisfy a predetermined criterion is referred to as "NG", meaning "No Good". If it is determined that the image quality is NG, the page number of a corresponding page and the content of NG determination are retrieved, and post-inspection data having a combination thereof is generated. This post-inspection data is stored in an inspection result storage unit 708, and transmitted to an inspection operation determination unit 709. The inspection result storage unit 708 updates the number of times of occurrence of a combination of the page number and the NG determination content based on the combination in the input post-inspection data, and stores the updated number in the inspection result DB 713. Using the post-inspection data transmitted from the image inspection unit 707, the inspection operation determination unit 709 acquires the number of times of NG occurrence (frequency of occurrence) in the combination in the post-inspection data from the inspection result DB 713 of the inspection result storage unit 708. Moreover, it is determined whether or not the acquired number of times of NG occurrence is larger than the predetermined threshold (predetermined value), and, if it is determined that the number is larger than the threshold, that effect is displayed on an inspection result display unit 710 as necessary. Furthermore, a request to perform various control processes is given to an inspection device controller 711, and the image forming apparatus 101 is notified via an external communication unit 712 of a request to stop the image forming operation. The inspection device controller 711 has a CPU 714 that performs the above-described various control processes, a memory 715 that stores programs to be executed by the CPU 714, and the like, and an example will be described in which the inspection device controller functions as a print control apparatus according to the embodiment.

Next, a method for inspecting the print quality using the inspection device 102 will be described. Here, in this embodiment, a configuration will be described in which difference comparison between pixel values is performed.

Reflected light from the paper 410 illuminated by the illuminating unit 411 for image scanning is scanned by the sensor 403. A darkness value difference between pixels is obtained in the image data scanned in this manner, and it is determined whether or not printing is properly performed according to the difference value. For example, in the case of PDL printing, original image data obtained by converting PDL data is taken as reference data, and is compared with image data obtained by scanning an image printed based on that original image data. The reference data and the scanned image data are respectively converted by the resolution converters 705 and 706 such that they have similar resolutions, and matching is performed for each image on the bitmap.

In this embodiment, both the image data sets are each divided into (5×5 pixel) blocks, and darkness comparison is performed in RGB or CMYK between pixels in each block. In this example, whether the comparison is to be performed in RGB or in CMYK can be changed according to the image type. For example, it is assumed that RGB comparison is performed in the case of color image data and CMYK (only K) comparison is performed in the case of monochrome image data.

Figure 9:
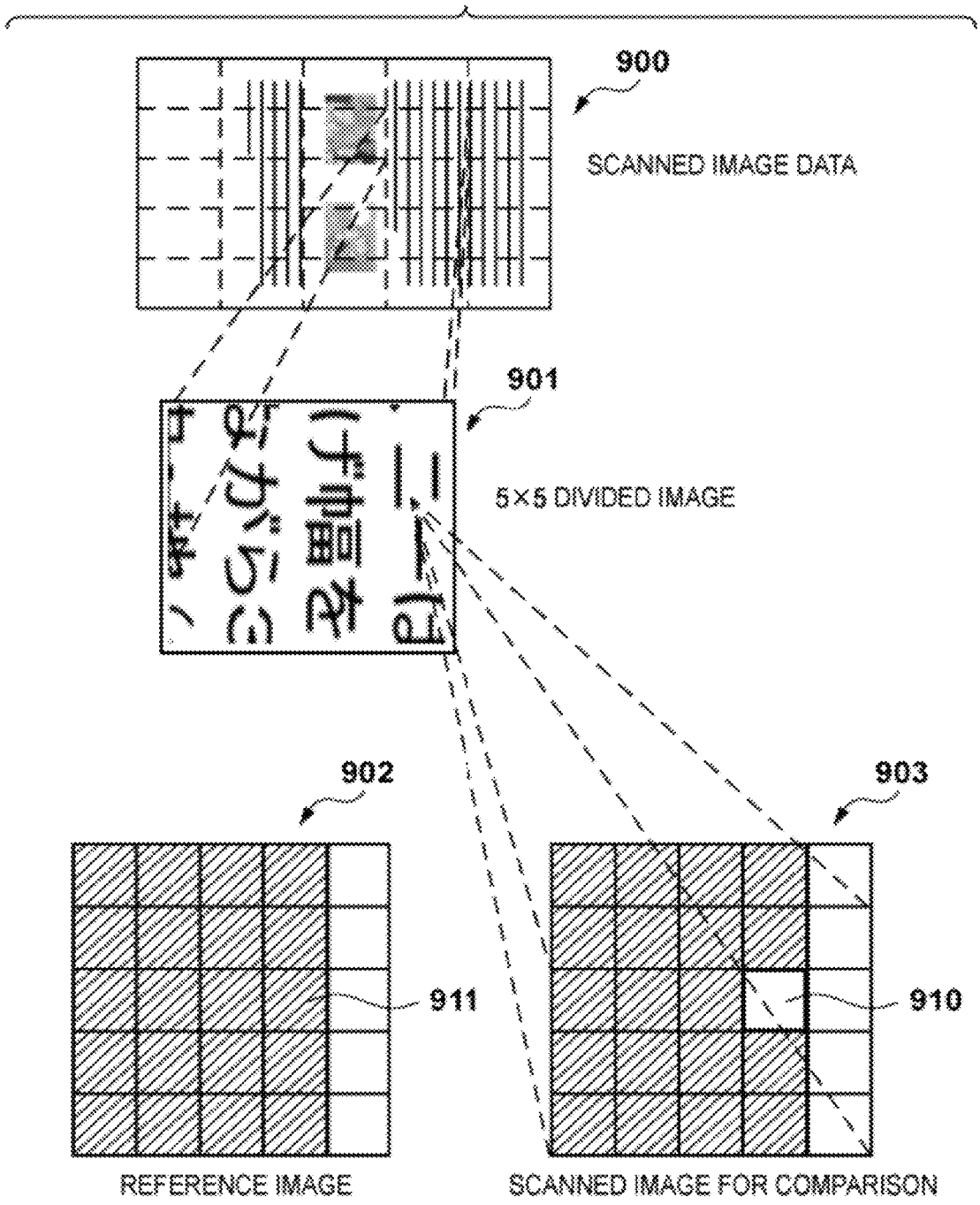
FIG. 9 is a view illustrating image comparison example between 5×5 blocks.

FIG. 9 is a view illustrating image comparison example between 5×5 blocks.

In the drawing, 900 denotes an image scanned by the sensor 403. 901 denotes an image divided into a 5×5 block after the resolution conversion by the resolution converter 706. 902 denotes one portion (5×5 block) extracted from the reference image data, and 903 denotes the corresponding portion extracted from the image 901. Here, the darkness data is multi-valued data ranging from 0 to 255.

The absolute value of a comparison value is calculated by:

Comparison value=[Image data value obtained by scanning paper]−[Data value of reference image] and a preset permissible darkness difference are compared with each other, and, if |Comparison value|≤(Permissible darkness threshold), it is determined that the print quality is OK in that pixel. Otherwise, it is determined that the print quality is NG.

In the example in FIG. 9, some dust is present at a pixel 910, and, thus, the darkness value is read as a low value although a pixel value indicating dark color is to be read. In this example, it is assumed that the permissible darkness threshold is set to "40". Here, if the darkness data value of a pixel 911 is "255" and the darkness value of the pixel 910 is "127", |Comparison value|=|127−255|=128(>40). That is to say, this value is larger than the permissible darkness threshold, and, thus, it is determined that the corresponding pixel is NG.

In this manner, the darkness value for each pixel is determined for each 5×5 block, and an OK ratio for each block is obtained. The OK ratio for each block and a threshold set by a desired method are compared with each other. For example, if the threshold is 90% and the number of NG pixels in the block is one, OK ratio (24/25=96(%))>threshold (90%). In this case, the inspection result of this block is OK. Such an inspection process is performed on the entire face of paper, and the print quality of this paper is determined to be OK if OK is obtained in all blocks, and determined to be OK or NG depending on conditions or the like otherwise.

Furthermore, in this embodiment, the inspection method is divided as shown in FIGS. 12A to 12D regarding the above-described difference comparison between pixel values.

FIGS. 12A to 12D are views illustrating a specific example of an inspection process by the inspection device 102.

Figure 12A:
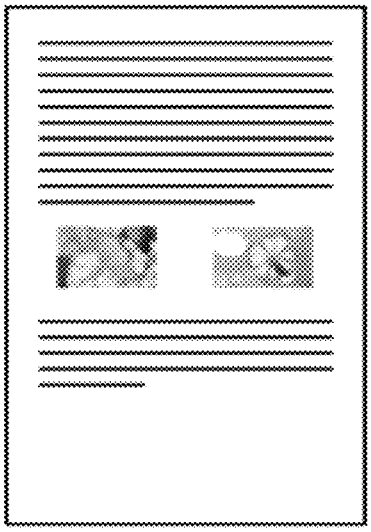
FIGS. 12A to 12D are views illustrating a specific example of an inspection process by the inspection device.
Figure 12B:
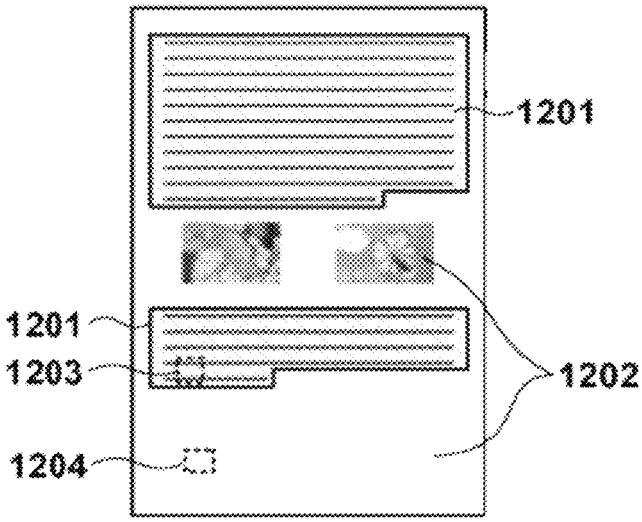

FIG. 12A shows scanned image data of paper scanned by the sensor 403 in the inspection device 102. FIG. 12B is a view showing a result obtained by performing image area separation on the image data in FIG. 12A. Here, such image area separation is performed, based on document image data scanned by the scanner unit 301 in the case of copying, and based on PDL document data in the case of PDL printing. In the drawing, 1201 denotes a region determined to be a character region, and 1202 denotes a region determined to be a non-character region, which is not a character region.

Figure 12C:
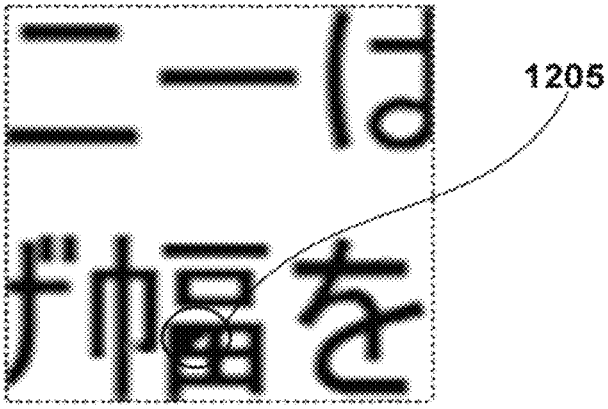

FIG. 12C is an enlarged view of a region 1203 in FIG. 12B. Character distortion occurs at a circled portion 1205. This is a phenomenon in which a portion enclosed by black lines in a character, which is to be printed as a white spot in the original image data, is printed in a dark color. The reason for this seems to be mainly that, since a space between black lines is narrow, charge for forming a latent image infiltrates the space during formation of the latent image. In this case, the inspection device 102 determines that the print quality is NG.

Figure 12D:
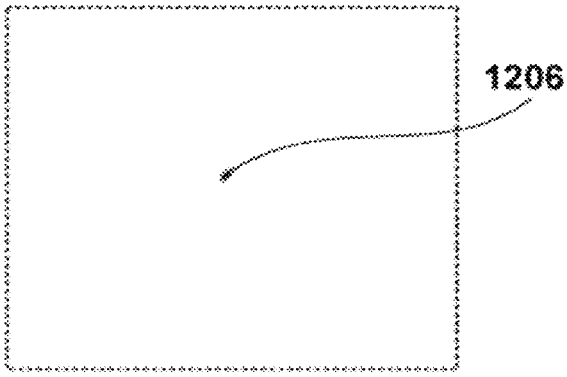

FIG. 12D is an enlarged view of a region 1204 in FIG. 12B. 1206 appears as a single noise image in its surrounding white region. The reason for this seems to be not relevant to image data as in the case of character distortion as described above, but to very small dust accidentally present at the scanning position when scanning is performed by the sensor 403. Also in this case, the inspection device 102 determines that the print quality is NG.

As described above, if the non-character region 1202 is determined to be NG, it is highly possible that the NG is caused by scanning dust. Furthermore, if the character region 1201 is determined to be NG, it is highly possible that the NG is caused by character distortion. In the strict sense, dust may be present also in a character region, and, thus, NG determined in character regions is not always caused by character distortion. However, since the possibility that dust is present on paper may be low, the NG can be considered to be caused by character distortion.

As described above, a factor that causes NG in a character region is different from a factor that causes NG in a non-character region.

Next, combination information stored in the inspection result storage unit 708 will be described with reference to FIG. 11.

Figure 11:
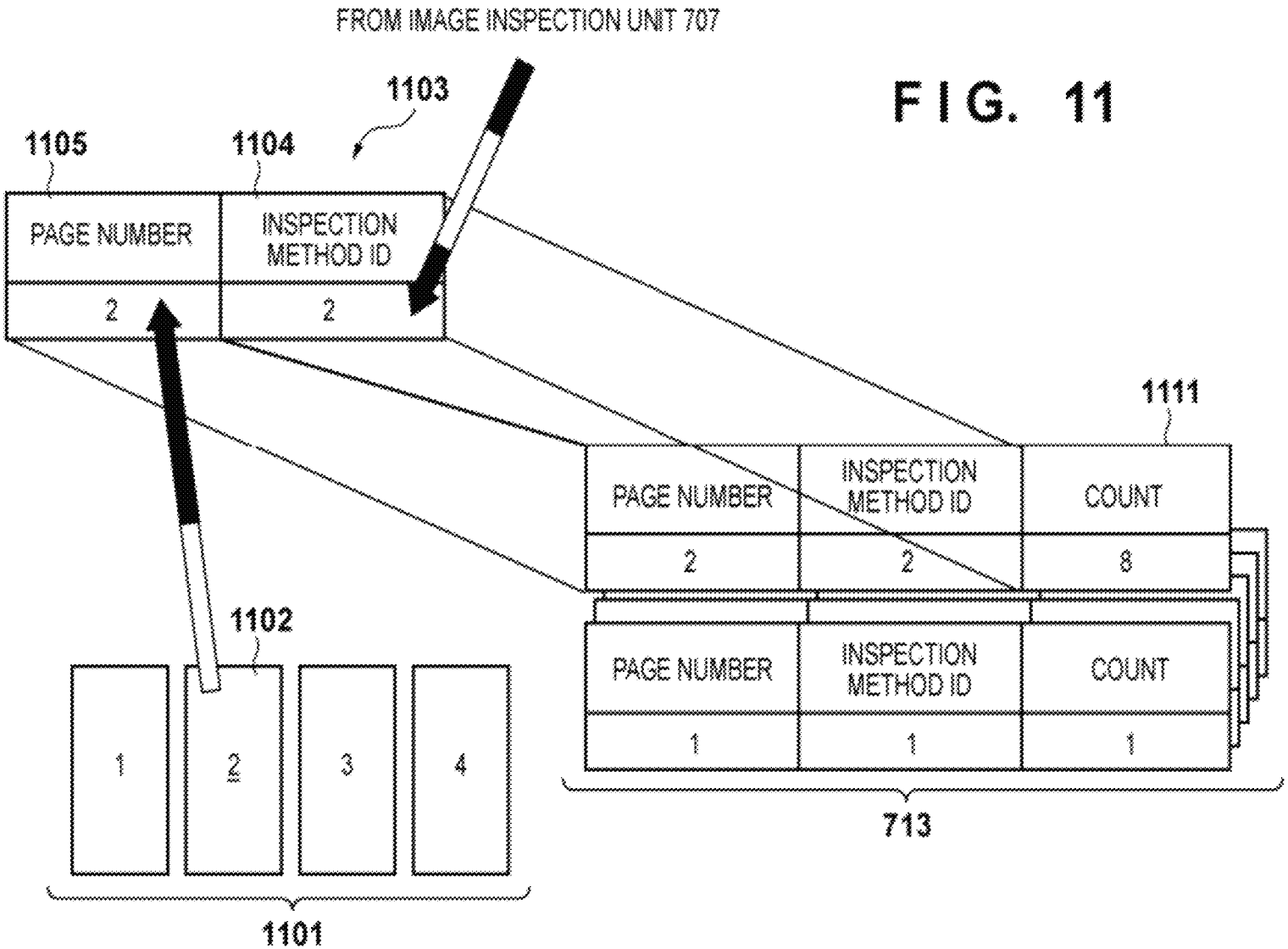
FIG. 11 is a diagram illustrating information stored in a DB of an inspection result storage unit according to the embodiment.

FIG. 11 is a diagram illustrating information stored in the inspection result DB 713 of the inspection result storage unit 708 according to the embodiment.

In the drawing, 1101 denotes paper inspected by the inspection device 102. Here, the number on the paper indicates the page number of that print paper. It is assumed that the sheet of paper 1102 determined to be NG in the paper 1101 is on the 2nd page. At that time, a page number 1105 is acquired as "2". Next, with the page number "2", it is assumed that an inspection method ID 1104 indicating a determination content of NG determination is "2". This inspection method ID is information for indicating each of a plurality of inspection methods, and, in this embodiment, "1" is allocated when inspection is performed according to difference comparison between pixel values in a non-character region. Furthermore, "2" is allocated when inspection is performed according to difference comparison between pixel values in a character region. The information on the inspection method is supplied from the image inspection unit 707.

Next, the page number 1105 and the inspection method ID 1104 are stored in the inspection result storage unit 708 as NG combination information 1103 in the case where NG occurs. The inspection result storage unit 708 counts the number of times of occurrence of each type of the NG combination information 1103. The inspection result DB 713 stores the number of times of occurrence of each type of the NG combination information 1103. In this example, each time NG occurs, the corresponding occurrence count of the NG combination information 1103 is incremented by one and stored. The example in FIG. 11 shows that, when an inspection method with the inspection method ID "2" is used in the 2nd pages, the NG determination count (the number of times of occurrence) 1111 is 8 times.

Next, inspection result and operation control of the image forming apparatus when performing printing of a plurality of sets according to this embodiment will be described with reference to FIG. 13.

Figure 13:
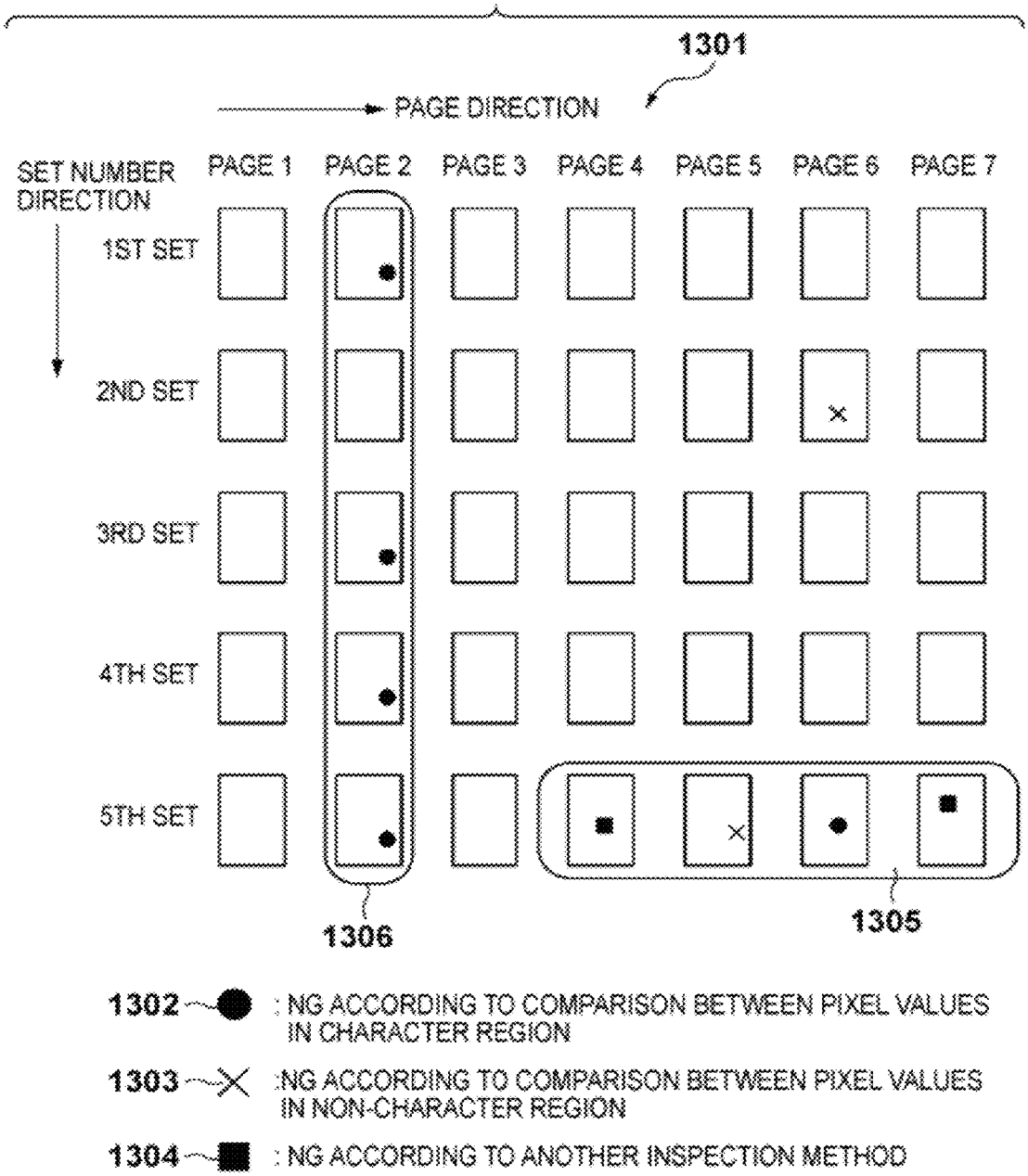
FIG. 13 is a diagram illustrating a reference method of an inspection result when performing printing of a large number of sets.

FIG. 13 is a diagram illustrating a reference method of an inspection result when performing printing of a plurality of sets.

In the drawing, 1301 denotes paper printed and discharged by the image forming apparatus 101. The example in FIG. 13 shows a state in which 5 sets of paper with each set having 7 pages are printed. In the drawing, 1302 shows that the print quality is determined to be NG according to comparison between pixel values in a character region as described above. 1303 shows that the print quality is determined to be NG according to comparison between pixel values in a non-character region as described above. 1304 shows that the print quality is determined to be NG according to an inspection method other than the above.

1305 shows a state in which NG has successively occurred in four pages from the 4th page in the 5th set. In this example, regardless of the NG determination content, if NG successively occurs in a predetermined number of pages or more, the operation of the image forming apparatus 101 is stopped. The reason for this is that, if NG occurs in successive pages, the NG seems to occur due to a problem of the image forming apparatus 101, and the factor that causes the NG may not limited to one. In this case, it is difficult for the image forming apparatus 101 to properly perform printing, and, it seems that, if printing is performed in a continuous manner, the print quality becomes poor, and the paper is wasted. Accordingly, the printing operation of the image forming apparatus 101 has to be immediately stopped in such a case. In this embodiment, for the sake of simplicity of the explanation, pages up to 7 pages in the 5th set are shown. For example, when a threshold is set such that the operation of the image forming apparatus 101 is stopped if NG successively occurs in 10 pages, in the example in FIG. 13, the printing operation of the image forming apparatus 101 is stopped if NG is successively detected up to the 6th page in the 6th set.

1306 shows a state in which NG is detected in four sheets of paper namely in the 2nd pages in the 1st set and the 3rd to the 5th sets. Moreover, in each sheet of paper, NG is detected by the comparison method 1302 between pixel values in a character region. In this manner, according to this embodiment, if NG is detected at a predetermined frequency or more due to the same NG factor in multiple sets as described in FIG. 11, the operation of the image forming apparatus 101 is stopped. The reason for this is that it is considered that, if NG is detected due to the same NG factor in the same pages in multiple sets, image data of that page has a problem. For example, it is considered that character distortion has occurred because the character size in the corresponding page is small. If NG is detected in this manner, the reusability can be improved by correcting image data of the corresponding page, performing printing again, and then merging that paper. In consideration of such a case, there may be a case in which it is desirable to stop the operation of the image forming apparatus 101 after printing all sheets of paper in that set, even if the frequency of occurrence of NG reaches a predetermined frequency. For example, if the frequency of occurrence of NG reaches a predetermined frequency at the 2nd page in the Nth set (N is a positive integer of 6 or more), the printing operation is continued until all pages (up to the 7th page) in that set are printed, and when printing of the 7th page is completed, the operation of the image forming apparatus 101 is stopped.

Moreover, the operation unit 207 adopts different display methods between the case in which NG is detected in successive pages as shown in 1305 and the case in which the NG detection frequency in multiple sets reaches a predetermined threshold as shown in 1306.

Figure 14A:
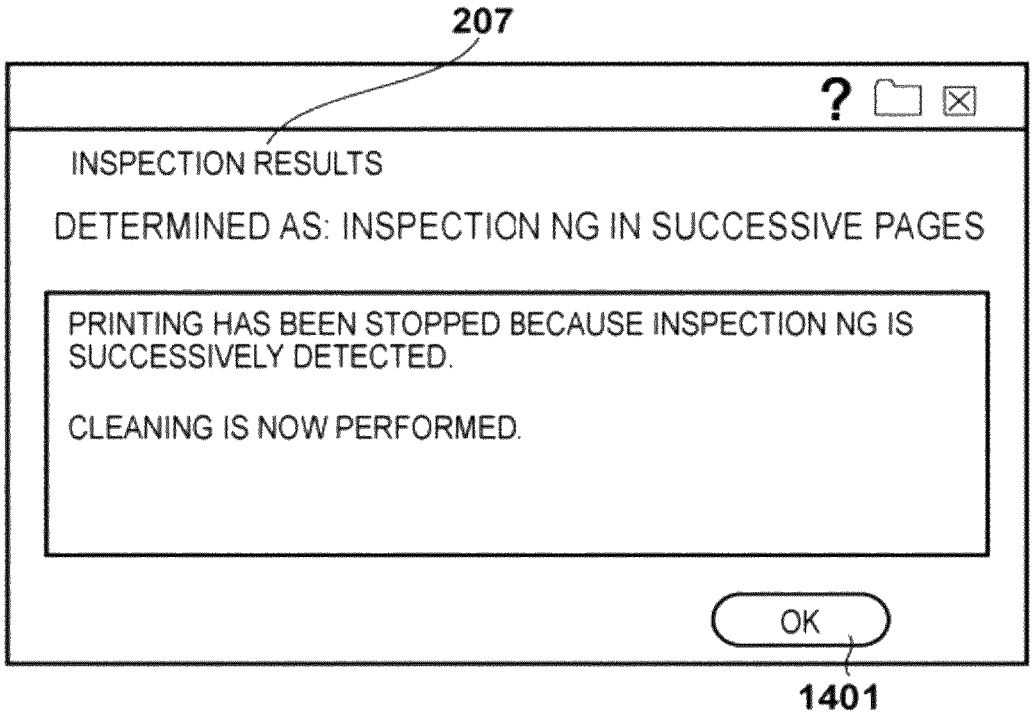
FIGS. 14A and 14B are views showing display examples of an operation unit according to the NG type.
Figure 14B:
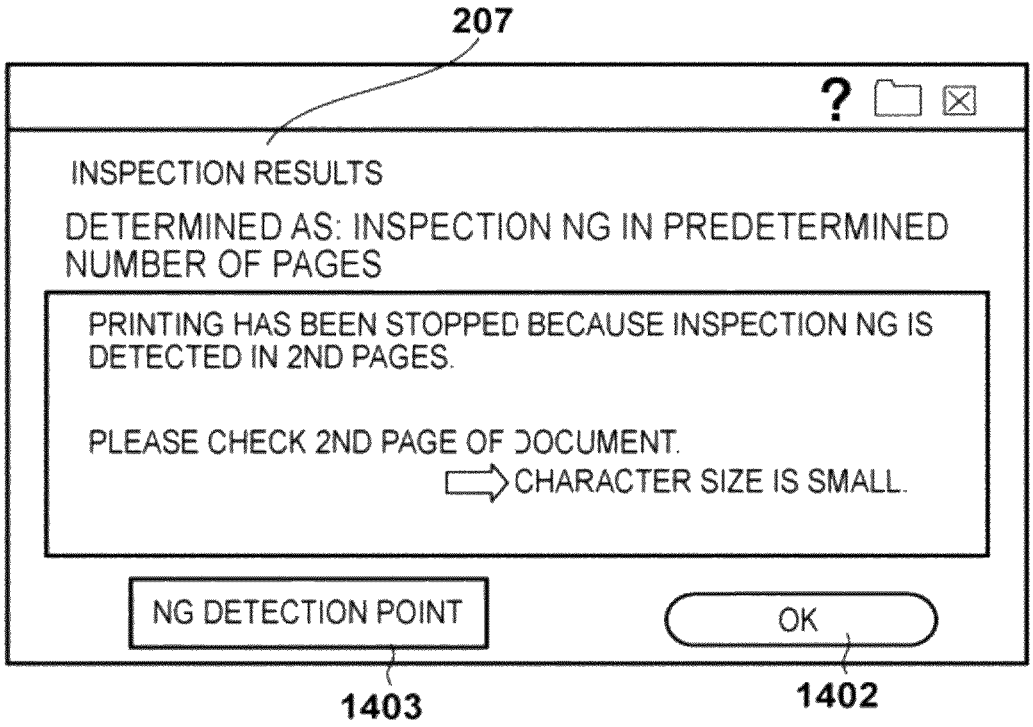

FIGS. 14A and 14B are views showing display examples of the operation unit 207 according to the NG type.

FIG. 14A shows a display example on the operation unit 207 when NG is detected in successive pages as shown in 1305 in FIG. 13, and the operation of the image forming apparatus 101 is stopped. In this example, NG is detected in successive pages, and, thus, the NG may have been caused by the printer engine of the printer unit 206. Accordingly, in this case, after the operation of the image forming apparatus 101 is stopped, a message prompting a user to perform a cleaning operation is displayed. Here, the user can start the cleaning operation by pressing an OK button 1401.

FIG. 14B shows a display example when NG occurs due to the same factor in multiple sets as shown in 1306 in FIG. 13. This screen is displayed on the display unit of the operation unit 207 after the operation of the image forming apparatus 101 is stopped. In this example, NG is detected at a predetermined frequency or more in the 2nd pages in multiple sets, and the print quality is determined to be NG in a character region according to pixel value comparison. Accordingly, for example, it is determined that character distortion occurs because the character size of an image in the 2nd page of the document is small. Thus, a message prompting the user to check the character size or the like in the 2nd page of the document is displayed. Here, the user can cancel this display by pressing an OK button 1402. Furthermore, an NG detection point button 1403 is a button for giving an instruction to display points where NG is detected at a predetermined frequency or more. Furthermore, the NG detection point button 1403 may be provided in the screen in FIG. 14A.

Figure 15:
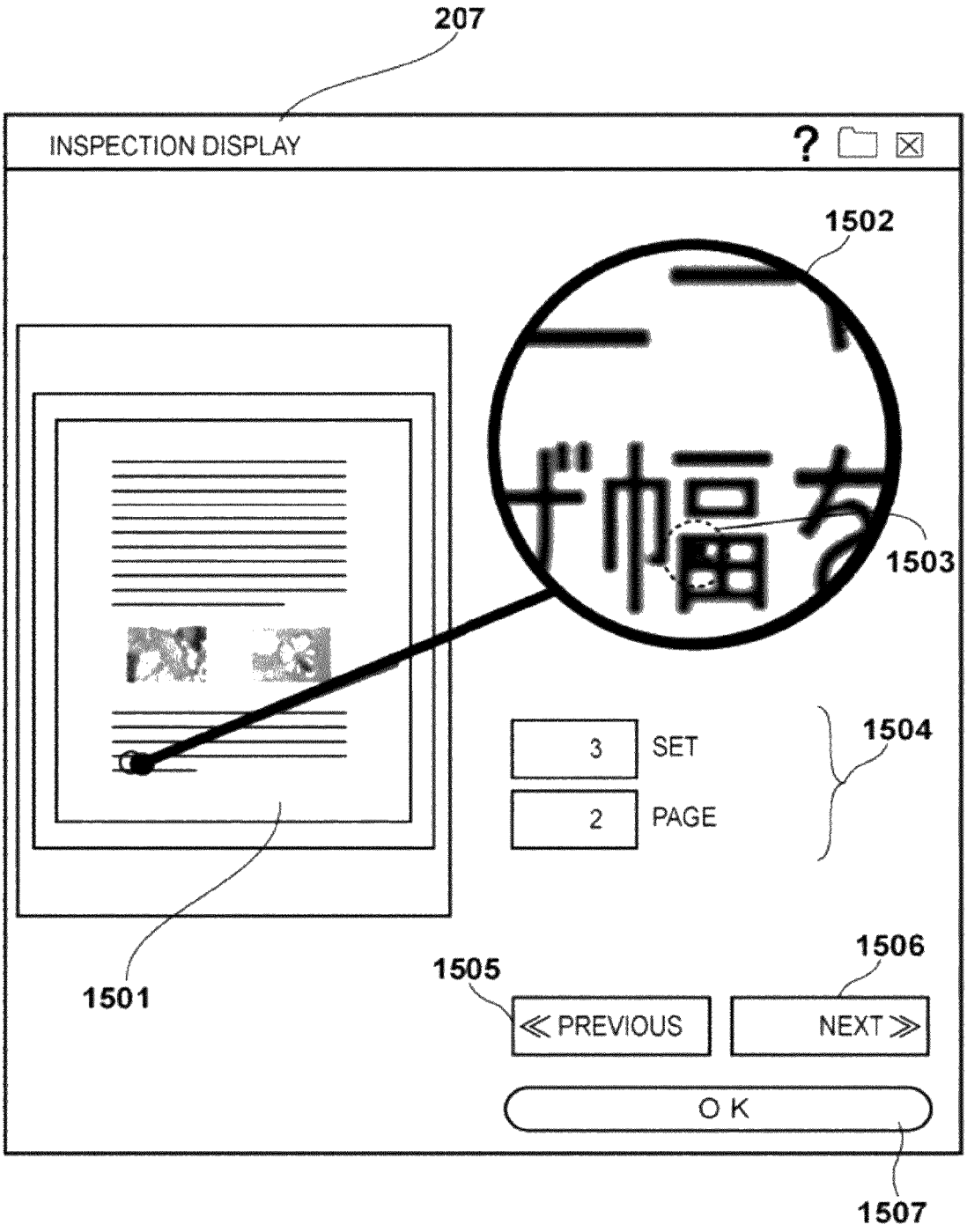
FIG. 15 is a view showing an exemplary screen displayed when an NG detection point button has been pressed.

FIG. 15 is a view showing an exemplary screen displayed when the NG detection point button 1403 has been pressed in FIG. 14B.

In the drawing, 1501 denotes a thumbnail of a page in which NG is detected. 1502 shows an enlarged view of a point in which NG is actually detected in the thumbnail 1501. 1503 shows a point in which the print quality is actually determined to be NG in the enlarged view 1502. Here, 1503 is indicated for the sake of explanation in this embodiment, and is not actually displayed. 1504 show the set number and the page number of the thumbnail 1501. This example shows that the 2nd page in the 3rd set is determined to be NG. 1505 indicates a button for displaying the previous page determined to be NG, and, if the button 1505 is selected, the 6th page in the 2nd set is displayed in the example in FIG. 13. 1506 is a button for displaying the next page determined to be NG, and, if this button is pressed, the 2nd page in the 4th set is displayed in the example in FIG. 13. An OK button 1507 is a button for cancelling the NG detection point display, and, if the user presses this button, the display is switched to a predetermined display.

Here, if the button 1505 is pressed in FIG. 15, the display may be returned to the 2nd page in the 1st set, which is the previous page determined to be NG in 1306 caused by the same NG 1302 in FIG. 13. In this manner, NG points between which the display is switched by the previous button 1505 and the next button 1506 in FIG. 15 may be limited to pages classified as in 1305 and 1306 in FIG. 13.

Next, the operation of the inspection device 102 according to the embodiment will be described.

Figure 10A:
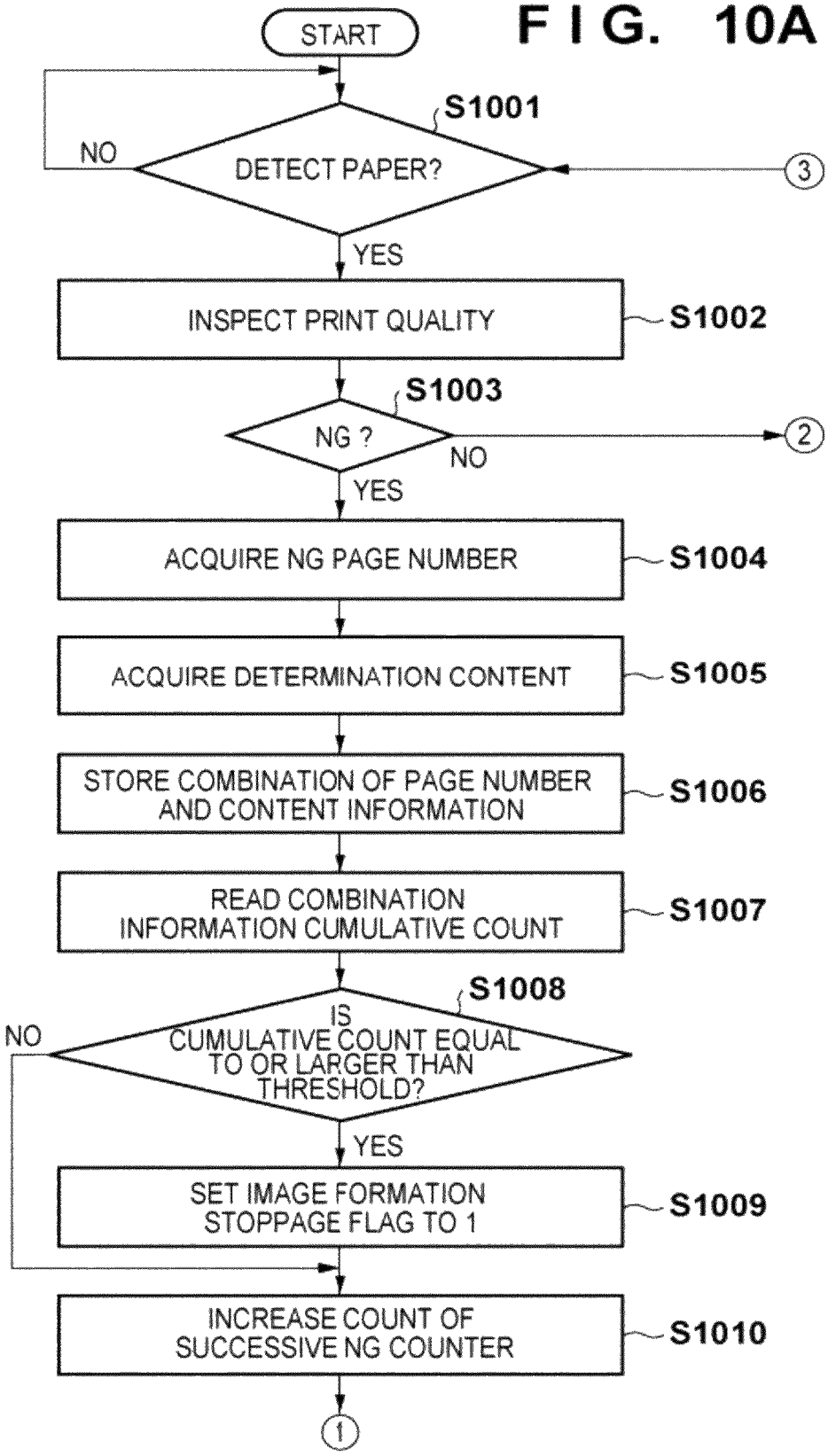
FIGS. 10A and 10B are flowcharts illustrating a process that controls the operation of the image forming apparatus using the inspection device.
Figure 10B:
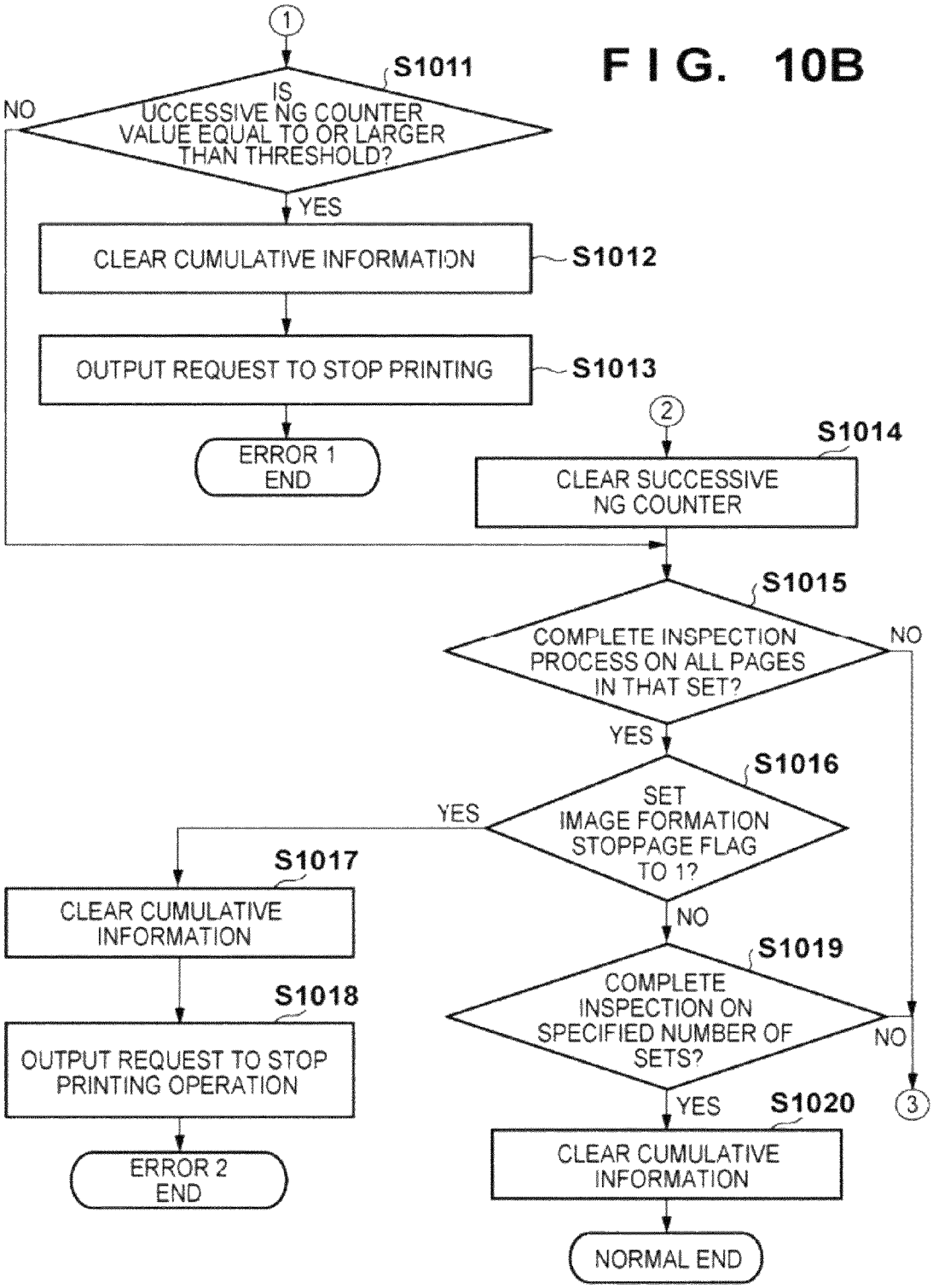

FIGS. 10A and 10B are flowcharts illustrating a process that controls the operation of the image forming apparatus using the inspection device 102 according to the embodiment. Here, a program for performing this process is stored in the memory 715, and executed under the control of the CPU 714.

First, in S1001, it is determined whether or not paper has been fed to the inspection device 102. When paper discharged from the image forming apparatus 101 is drawn by the paper feed rollers 401 into the inspection device 102, a paper detection sensor (not shown) of the inspection device 102 detects the paper, and the procedure advances to S1002. In S1002, as described in FIG. 7, the image inspection unit 707 inspects the print quality for each page. Next, the procedure advances to S1003, where it is determined whether or not NG has been detected by the image inspection unit 707. If NG has been detected, the procedure advances to S1004, where the image inspection unit 707 acquires the page number at which NG is detected. The page number may be acquired by any method. For example, the number of pages may be automatically counted when paper is detected in S1001, or page information transmitted in synchronization with the discharge timing of paper from the image forming apparatus 101 may be received.

Next, the procedure advances to S1005, where the image inspection unit 707 acquires content information of NG determination. Then, the procedure advances to S1006, where the page number information and the determination content are combined by the image inspection unit 707, and stored in the inspection result storage unit 708. Next, the procedure advances to S1007, where the cumulative count of the combination matching the NG combination information 1103 is read. At that time, in the inspection operation determination unit 709, the NG combination information 1103 and the corresponding NG determination count 1111 of the NG combination information 1103 are read from the inspection result storage unit 708.

In the example in FIG. 11, it is seen that the cumulative count when the inspection method ID is "2" in the 2nd pages is 8 times.

Next, the procedure advances to S1008, where the cumulative count and a threshold (a first predetermined value) are compared with each other. In S1008, if the inspection operation determination unit 709 determines that the cumulative count is equal to or larger than the threshold, for example, if the threshold is 8, the procedure advances to S1009. In S1009, since it is determined that the cumulative count is equal to or larger than the threshold, the inspection operation determination unit 709 determines that the productivity of printed materials is not improved anymore even if the printing process is continued by the image forming apparatus, and, thus, determines to stop the operation of the image forming apparatus 101. Here, in this embodiment, when stopping the operation of the image forming apparatus 101 due to NG in the set number direction, the operation is not stopped until printing of all pages in that set is completed. Thus, in this example, an image formation stoppage flag is set to "1", and the printing operation is stopped when printing of all pages in that set is completed. The image formation stoppage flag is provided in the memory 715.

Here, the image formation stoppage flag is part of information used in the inspection operation determination unit 709, and is set to "1" if the inspection result in S1008 is YES. Next, the procedure advances to S1010, where the inspection operation determination unit 709 increases the count of a successive NG counter. This successive NG counter is also part of information used in the inspection operation determination unit 709. This counter indicates the number of successive times where the print quality is determined to be NG in the page direction regardless of the determination content. Then, the procedure advances to S1011, where the inspection operation determination unit 709 determines whether or not the value is equal to or larger than a successive NG count threshold. For example, if the successive NG count threshold is 10 pages as described with reference to FIG. 13, the procedure advances to S1012 when the successive NG counter value (count value) is 10 or more. Here, if it is determined in S1011 that the successive NG counter value is equal to or larger than the successive NG count threshold, it is highly possible that the image forming apparatus 101 has a problem, and, thus, the printing operation has to be immediately stopped in order to prevent wasteful printing and to promote resource saving.

In S1012, the inspection operation determination unit 709 clears cumulative information. Here, the cumulative information refers to the contents of the successive NG counter, the image formation stoppage flag, and the NG history DB 1110 described in FIG. 11. Next, the procedure advances to S1013, where a request to stop the printing operation is output to the image forming apparatus 101. Here, in FIG. 10B, the procedure reaches "Error 1 end" when NG is detected in a predetermined number of successive pages. In this case, a screen as described in FIG. 14A is displayed on the operation unit 207.

On the other hand, the case will be described in which the inspection operation determination unit 709 determines in S1008 that the cumulative count of the combination is not equal to or larger than the threshold. Also in this case, in S1010, the inspection operation determination unit 709 increases the count of the successive NG counter, and the procedure advances to S1011. Next, after the procedure advances to S1011, if the inspection operation determination unit 709 determines that the successive NG counter value is smaller than the threshold, the procedure advances to S1015. In S1015, the inspection operation determination unit 709 determines whether or not inspection on all pages in that set has been completed. If it is determined that inspection on all pages has not been completed, the procedure advances to S1001.

In S1015, if the inspection operation determination unit 709 determines that the inspection process on all pages in that set has been completed, the procedure advances to S1016. In S1016, the inspection operation determination unit 709 determines whether or not the image formation stoppage flag is "1". The image formation stoppage flag "1" indicates that the cumulative number of times of occurrence of a combination in the same pages in multiple sets is equal to or larger than the threshold. In this case, the procedure advances to S1017, where the inspection operation determination unit 709 clears the cumulative information. Next, the procedure advances to S1018, where a request to stop the printing operation is output to the image forming apparatus 101. Here, in the drawing, the procedure reaches "Error 2 end" when it is determined that the number of times of occurrence of a combination is equal to or larger than the threshold in the case where the same NG occurs in the same pages in multiple sets. In this case, a screen as described in FIG. 14B is displayed on the operation unit 207. Furthermore, the procedure reaches S1018 when the print quality inspection has been completed on all pages in that set, and, thus, the user can see at which page NG has intensively occurred. Accordingly, for example, it is possible to recognize that the 2nd page of the document has a problem, and to correct the 2nd page of the document as shown in FIG. 14B.

Here, in the case of conditions not described above, the procedure in the flowchart advances to S1019 in the end. In this example, the inspection operation determination unit 709 determines whether or not the inspection process of the print quality has been completed on all pages of paper in the specified number of sets. If it is determined that the inspection process on all pages of paper in the specified number of sets has not been completed, the procedure advances again to S1001, where the procedure is put on standby for the inspection operation for the next paper. Furthermore, if the inspection operation determination unit 709 determines in S1019 that the inspection process on all pages of paper in the specified number of sets has been completed, there has been no critical NG with which the image forming apparatus 101 has to be stopped. In this case, the procedure advances to S1020, where the inspection operation determination unit 709 clears the cumulative information, and then advances to a normal end.

Figure 16A:
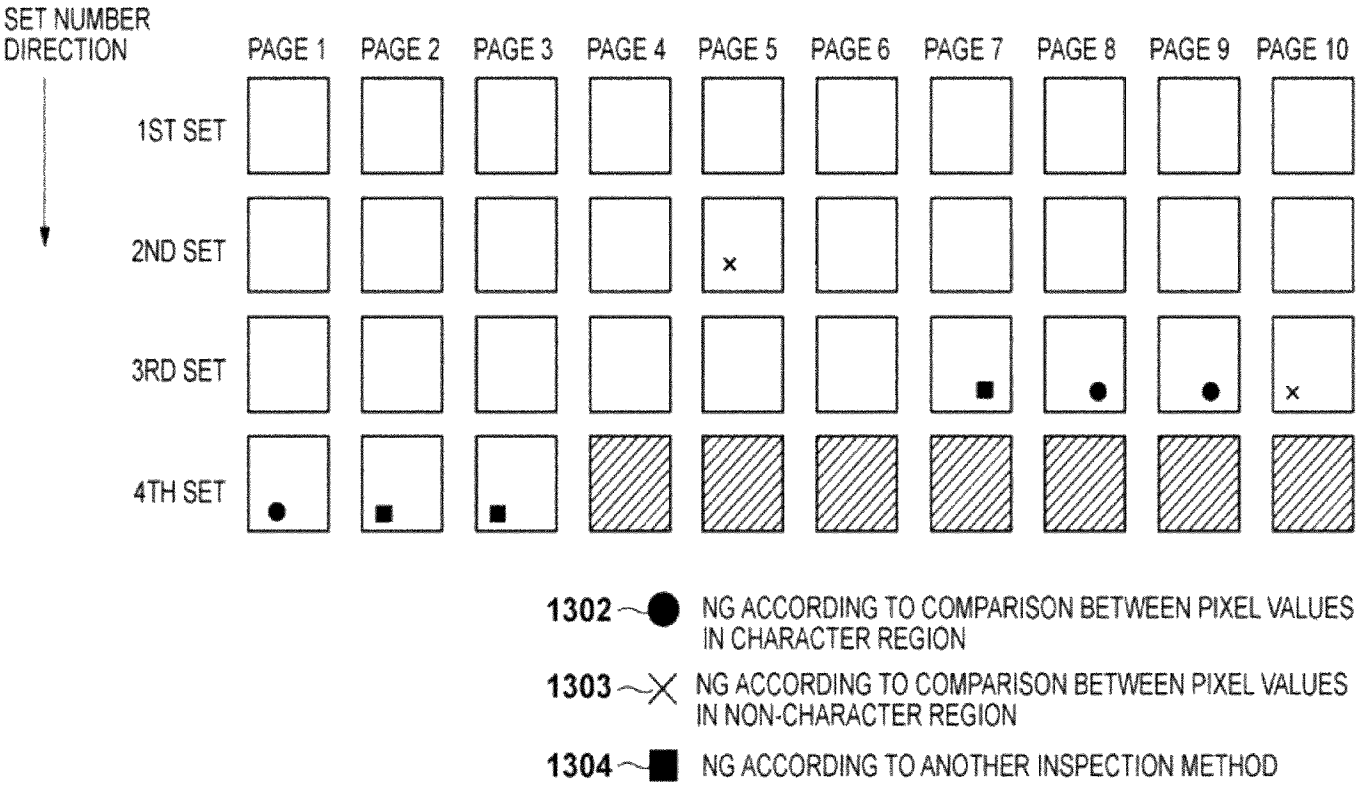
FIGS. 16A and 16B are diagrams illustrating exemplary inspection results when performing printing of a large number of sets.
Figure 16B:
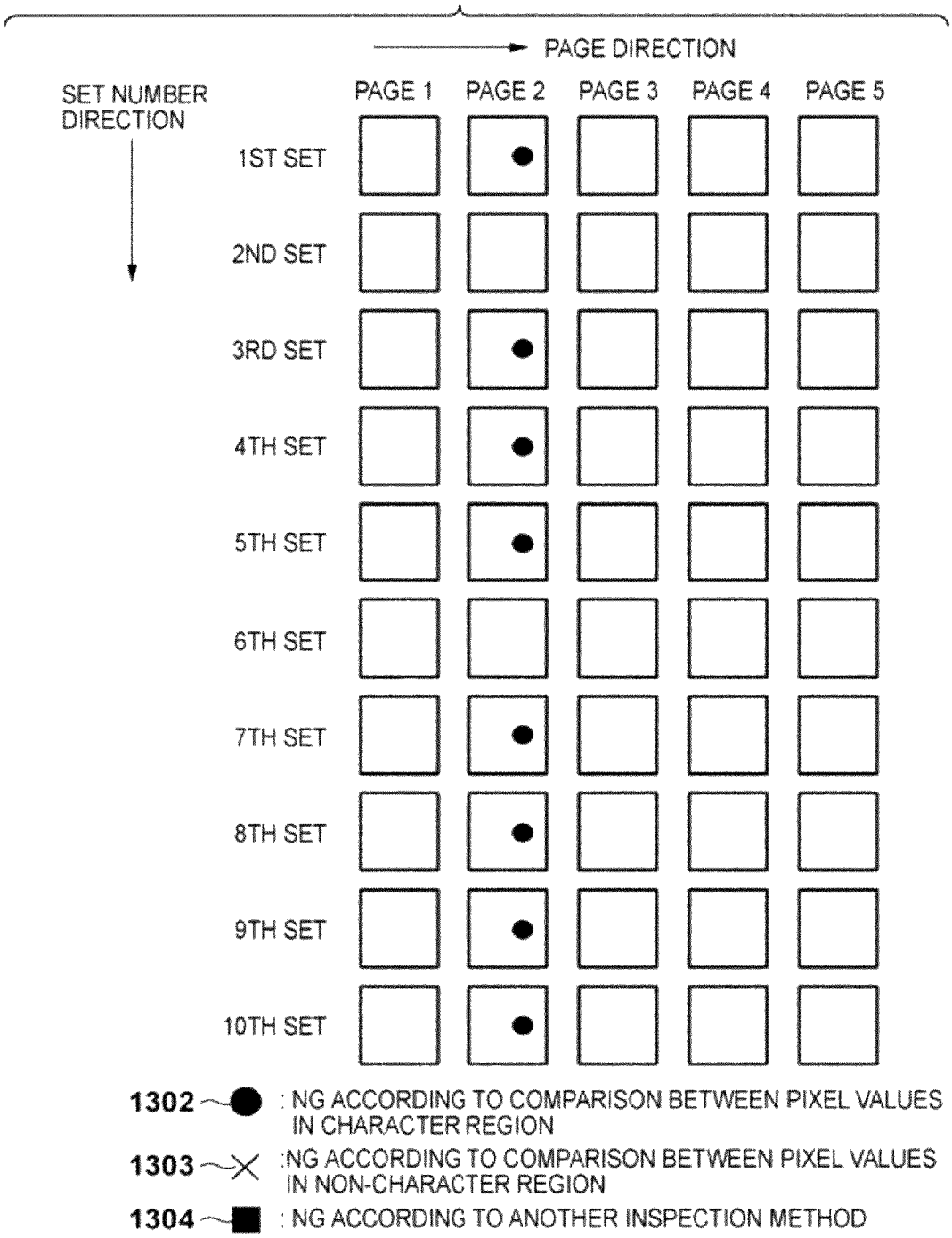

Hereinafter, two types of states will be described in detail with reference to the inspection results in FIGS. 16A and 16B. FIGS. 16A and 16B are diagrams illustrating inspection results and operation control of the image forming apparatus when performing printing of a large number of sets described in FIG. 13.

In the Case where Pages are Determined to be NG Successively in the Page Direction FIG. 16A shows a state in which 5 sets of paper with each set having 10 pages are to be printed, and the successive NG count threshold is set to "7". Here, the printing process has to be stopped during printing of the 4th set, and, thus, FIG. 16A shows sets only up to the 4th set. Furthermore, pages from the 4th page in the 4th set are grayed out because they are not actually printed.

Hereinafter, the control operation of the inspection operation determination unit 709 will be described with reference to the flowcharts in FIGS. 10A and 10B.

In S1001 in FIG. 10A, the inspection device 102 waits for the entrance of paper. If the printing process is started, and printed paper enters the inspection device 102, the procedure advances to S1002, where the quality of an image printed on that paper is inspected. Next, in S1003, it is determined whether or not the inspection result is NG. Here, in FIG. 16A, NG does not occur in the 1st page in the 1st set, and, thus, the procedure advances to S1014. In this manner, since NG does not occur in paper from the 1st page to the 10th page in the 1st set in FIG. 16A, the processes from S1001 to S1003, S1014, and S1015 are repeated. Then, if inspection on all 10 pages in the 1st set is completed, the procedure advances to S1016, where it is determined whether or not the image formation stoppage flag has been set to "1", and, in this case, since the image formation stoppage flag is "0", the procedure advances to S1019. In S1019, it is determined whether or not the inspection process has been completed on the specified number of sets. The procedure at this point is in the 1st set of specified 5 sets in total, and, thus, the procedure advances to S1001, and the inspection process is performed in a similar manner on pages of paper in the next set.

Then, if NG occurs in the 5th page in the 2nd set, the procedure advances from S1003 to S1004. In S1004, the page number is acquired. Since the number of pages in this case is "5", the page number 1105 is "5". Next, the procedure advances to S1005, where the determination content is acquired. Since the determination content in this case is according to comparison between pixel values in a non-character region, the inspection method ID 1104 is set to "1". Next, the procedure advances to S1006, where the combination {Page number 1105, Inspection method ID 1104}={5,1} is stored in the NG history DB 1110 of the inspection result storage unit 708. Then, the procedure advances to S1007, where the cumulative count of the combination {5,1} is read. In this case, the cumulative count of the combination is "1". Next, in S1008, it is determined whether or not the cumulative count read in S1007 is equal to or larger than the threshold. In this example, the threshold is set to "8", and, thus, (Cumulative count: 1)<(Threshold: 8), and the procedure advances to S1010.

In S1010, the count of the successive NG counter is increased (+1). Next, the procedure advances to S1011, where it is determined whether or not the count value in the successive NG counter is equal to or larger than the threshold. In this case, the successive NG counter value is "1" and the successive NG count threshold is set to "7", and, thus, (Successive NG counter value: 1)<(Successive NG threshold: 7), and the procedure advances to S1015. In S1015, since the process is still on the 5th page of paper in the 2nd set, the procedure advances again to S1001. Here, if NG is not detected, the successive NG counter is cleared to "0" in S1014. In the subsequent procedure, NG is not detected from the 6th page in the 2nd set to the 6th page in the 3rd set, and, thus, a description thereof has been omitted.

Next, since the procedure advances in a similar manner from the 7th page to the 9th page in the 3rd set, a description thereof will be given in a collective manner. Since the processes from S1001 to S1005 are as described above, a description thereof has been omitted. Next, in S1006, the combination of the page number 1105 and the inspection method ID 1104 is stored in the NG history DB 1110 of the inspection result storage unit 708. Here, combination information on the 7th, 8th, and 9th pages in the 3rd set is {Page number, Inspection method ID}={7,3}, {8,2}, and {9,2}. Then, the procedure advances to S1007, where the cumulative count of that combination information is read. The thus read cumulative count is "1" throughout from the 7th page to the 9th page. Thus, due to the determination in S1008, the procedure advances to S1010. Subsequently, the procedure advances in order of S1010, S1011, S1015, and then S1001.

Next, after the 10th page in the 3rd set, the inspection process has been completed on all pages of paper in the 3rd set, and, thus, the procedure advances from S1015 to S1016. However, in this example, since the procedure has not advanced via S1009, the image formation stoppage flag is "0", and the procedure advances via S1019 again to S1001. Since the processes on the 1st page and the 2nd page in the 4th set are as described above, a description thereof has been omitted.

Next, processing on the 3rd page in the 4th set will be described. The procedure advances from S1001 via S1008 and S1010 to S1011. In S1011, the successive NG counter value is "7", and is equal to the successive NG count threshold "7". Thus, the procedure advances to S1012, where the cumulative information is cleared. Next, the procedure advances to S1013, where a request to stop the operation is output to the image forming apparatus 101. In response to the request, the image forming apparatus 101 immediately stops the printing operation.

As described above, in NG detection in successive pages in the page direction, if the number of successive times of NG is equal to or larger than the threshold, a request to immediately stop the printing process is given to the image forming apparatus. Accordingly, wasteful printed materials are prevented from being generated.

In the Case where NG is Detected in the Same Pages in Multiple Sets

FIG. 16B is a view illustrating an NG occurrence example in the case where 10 sets of paper with each set having 5 pages are to be printed. It is assumed that, also in this case, the successive NG count threshold is set to "7".

Hereinafter, the operation of the inspection device according to the embodiment will be described with reference to the flowchart in FIGS. 10A and 10B.

In S1001 in FIG. 10A, if paper is fed to the inspection device 102, the procedure advances to S1002, where the print quality of that paper is inspected. Next, the procedure advances to S1003, where it is determined whether or not the inspection result is NG. In FIG. 16B, NG does not occur in the 1st page in the 1st set, and, thus, the procedure advances from S1003 to S1014, and, then, in S1015, since the inspection process has not been completed on all pages, the procedure advances to S1001.

Next, NG occurs in the 2nd page in the 1st set as shown in FIG. 16B.

The page number 1105 "2" is acquired in S1004, and the inspection method ID 1104 "2" is acquired in S1005. Next, in S1006, the combination information {Page number 1105, Inspection method ID 1104}={2,2} is stored in the NG history DB 1110 of the inspection result storage unit 708. Then, the procedure advances to S1007, where the cumulative count of the combination {2,2} is read, and the count is compared with the threshold in S1008. Since the combination cumulative count is "1" in the first set and is smaller than the threshold ("8"), the procedure advances to S1010, where the count of the successive NG counter is increased. Next, the procedure advances to S1011, where the successive NG counter value and the successive NG count threshold (second predetermined value) ("7") are compared with each other. At this stage, the counter value is smaller than the threshold, and, thus, the procedure advances to S1015.

Here, in the case where NG is detected in the same pages in multiple sets as in FIG. 16B, NG does not occur successively in the page direction, and, thus, a description of the procedure advancing from S1010 to S1015 will be omitted in the description below. In S1015, it is determined whether or not inspection on all pages of paper in the current set has been completed, and, if the inspection has not been completed, the procedure advances to S1001. Since the processes from the 3rd set to the 9th set are as described above, a description thereof has been omitted. Furthermore, the process on the 1st page in the 10th set is similar to that on the 1st pages in other sets, and, thus, a description thereof has been omitted.

Since NG occurs in the 2nd page in the 10th set, the procedure advances from S1003 to S1004, where the page number 1105 "2" is acquired, and, in S1005, the inspection method ID 1104 "2" is acquired. Next, in S1006, the combination information {Page number 1105, Inspection method ID 1104}={2,2} is stored in the NG history DB 1110 of the inspection result storage unit 708. Next, in S1007, the cumulative count of the combination information {2,2} is read. At that time, since the cumulative count of the combination {2,2} is "8", and is equal to the threshold ("8"), the procedure advances from S1008 to S1009, where the image formation stoppage flag is set to "1". Then, the procedure advances via S1010 and S1011 to S1015. In S1015, since the process is still on the 2nd page, the procedure advances to S1001.

Since control processes on the 3rd page and the 4th page in the 10th set are similar to each other, a description thereof will be given in a collective manner. The procedure advances from S1001, S1002, and to S1003, and, since NG does not occur in these pages, the procedure further advances to S1014. In S1014, the successive NG counter is cleared. Next, in step S1015, since the number of sheets of paper that have been processed in the 10th set is not "5", which is the number of pages per set, the procedure advances to S1001.

In the end, in the 5th page in the 10th set, NG does not occur, and, thus, the procedure advances from S1003 to S1014, where the successive NG counter is cleared. Next, in step S1015, since the number of pages in the 10th set is "5", the procedure advances to S1016. In S1016, it is determined whether or not the image formation stoppage flag is "1". Since the image formation stoppage flag is "1", the procedure advances to S1017, where the cumulative information is cleared. Next, in S1018, a request to stop the printing operation is output to the image forming apparatus 101. In response to the request, the image forming apparatus 101 immediately stops the printing.

As described above, in NG detection in the same pages in multiple sets as in FIG. 16B, the cumulative count of the combination information at that page according to the same inspection method is obtained, and, even if the cumulative count becomes equal to or larger than the threshold, the printing is not immediately stopped. Instead, the printing operation is stopped for the first time when the inspection process on all pages, that is, printing of all pages in the same set has been completed. Then, after the user takes measures to rectify the image data of the page in which NG has frequently occurred, only that page is printed again, the quality is inspected, and, if NG does not occur, that printed page is merged with the paper bundle that has been determined not to be NG.

As described above, according to this embodiment, when performing printing of a plurality of sets, the printing is stopped only if it is frequently determined that the print quality does not satisfy a predetermined criterion, and, thus, the printing can be continuously performed without increasing downtime of the image forming apparatus. Accordingly, it is possible to achieve effects of preventing a critical decrease in productivity and of making a contribution to resource saving because unnecessary printed materials can be prevented from being continuously generated.

Here, in this embodiment, for the sake of simplicity of the explanation, the case was described in which printing has been performed only on one face of printed paper fed from the image forming apparatus, but printing may be performed on both faces of paper. In this case, as described in FIGS. 4A and 4B, the sensor 403 may simultaneously scan both faces of the paper, and the inspection device 102 may inspect the scanned images on both faces of the paper simultaneously or in a time-divided manner.

OTHER EMBODIMENTS

Aspects of the present invention can also be realized by a computer of a system or apparatus (or devices such as a CPU or MPU) that reads out and executes a program recorded on a memory device to perform the functions of the above-described embodiment, and by a method, the steps of which are performed by a computer of a system or apparatus by, for example, reading out and executing a program recorded on a memory device to perform the functions of the above-described embodiment. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-092476, filed Apr. 18, 2011, which is hereby incorporated by reference herein in its entirety.

What is claimed is:

1. A print control apparatus that controls a printing unit that is able to print images on first and second sets of first and second pages, the print control apparatus comprising:

a determination unit configured to determine print quality of a print image printed by the printing unit;

a first counting unit configured to count the number of pages whose print quality is determined by the determination unit not to satisfy a predetermined criterion, among at least the first and send gages of the first or second sets;

a second counting unit configured to count the number of pages whose print quality is determined by the determination unit not to satisfy a predetermined criterion, for each of the first gage of the first and second sets and the second page of the first and second sets; and a control unit configured to stop printing by the printing unit in a case where a count value counted by the first counting unit reaches a first predetermined value and to stop printing by the printing unit in a case where a count value counted by the second counting unit reaches a second predetermined value.

2. The print control apparatus according to claim 1, wherein, in a case where the count value counted by the first counting unit reaches the first predetermined value, the control unit stops printing by the printing unit before printing in one of the first and second sets is completed, and in a case where the count value counted by the second counting unit reaches the second predetermined value, the control unit stops printing by the printing unit after printing in one of the first and second sets has been completed.

3. The print control apparatus according to claim 1, further comprising:

a storage unit configured to, when print quality is determined by the determination unit not to satisfy a predetermined criterion, store a page number associated with a page whose print quality is determined not to satisfy the predetermined criterion and a determination method by the determination unit.

4. The print control apparatus according to claim 1, further comprising:

a display unit configured to display a message when the control unit stops printing by the printing unit.

5. The print control apparatus according to claim 4, further comprising:

an instruction unit configured to instruct to display a point determined by the determination unit not to satisfy the predetermined criterion when the display unit displays the message.

6. The print control apparatus according to claim 1, wherein the print control apparatus further comprises:

a scanning unit configured to scan a print image printed by the printing unit on a sheet and output image data; and wherein the determination unit comprises:

a comparison unit configured to compare between the image data output by the scanning unit and image data based on which the print image is printed; and the determination unit determines the print quality of the print image based on a result of the comparison by the comparison unit.

7. A print control apparatus that controls a printing unit that is able to print images on first and second sets of first and second paces, the print control apparatus comprising:

a determination unit configured to determine print quality of a print image printed by the printing unit;

a counting unit configured to count the number of pages whose print quality is determined by the determination unit not to satisfy a predetermined criterion, for each of the first page of the first and second sets and the second page of the first and second sets; and a control unit configured to stop printing by the printing unit in a case where a count value counted by the counting unit reaches a predetermined value.

8. A method for controlling a printing unit that is able to print images on first and second sets of first and second pages, the method comprising:

a determination step of determining print quality of a print image printed by the printing unit;

a first counting step of counting the number of pages whose print quality is determined in the determination step not to satisfy a predetermined criterion, among the first and second pages of the first or second sets;

a second counting step of counting the number of pages whose print quality is determined in the determination step not to satisfy a predetermined criterion, for each of the first page of the first and second sets and the second page of the first and second sets;

a first control step of stopping printing by the printing unit in a case where a count value counted in the first counting step reaches a first predetermined value; and a second control step of stopping printing by the printing unit in a case where a count value counted in the second counting step reaches a second predetermined value.

9. A method for controlling a print controlling a printing unit that is able to print images on first and second sets of first and second pages, the method comprising:

a determination step of determining print quality of a print image printed by the printing unit;

a counting step of counting the number of pages whose print quality is determined in the determination step not to satisfy a predetermined criterion, for each of the first page of the first and second sets and the second page of the first and second sets; and a control step of stopping printing by the printing unit in a case where a count value counted in the counting step reaches a predetermined value.

10. The print control apparatus according to claim 1, wherein the first and second predetermined values are different.

11. The print control apparatus according to claim 1, further comprising:

a storage unit configured to store a page number associated with a page whose print quality is determined not to satisfy the predetermined criterion, wherein the second counting unit is configured to count the number of the first pages determined not to satisfy the predetermined criterion, based on the page number stored by the storage unit, and count the number of the second pages determined not to satisfy the predetermined criterion, based on the page number stored by the storage unit.

12. The print control apparatus according to claim 1, wherein the first counting unit is configured to count the number of successive pages whose print quality is successively determined by the determination unit not to satisfy the predetermined criterion.

13. The print control apparatus according to claim 7, wherein, in a case where the count value counted by the counting unit reaches the predetermined value, the control unit stops printing by the printing unit after printing in one of the first and second sets has been completed.

14. The print control apparatus according to claim 7, further comprising:

a storage unit configured to store a page number associated with a page whose print quality is determined not to satisfy the predetermined criterion and a determination method by the determination unit.

15. The print control apparatus according to claim 7, further comprising:

a display unit configured to display a message when the control unit stops printing by the printing unit.

16. The print control apparatus according to claim 15, further comprising:

an instruction unit configured to instruct to display a point determined by the determination unit not to satisfy the predetermined criterion when the display unit displays the message.

17. The print control apparatus according to claim 7, wherein the print control apparatus further comprises:

a scanning unit configured to scan a print image printed by the printing unit on a sheet and output image data; and wherein the determination unit comprises:

a comparison unit configured to compare between the image data output by the scanning unit and image data based on which the print image is printed; and the determination unit determines the print quality of the print image based on a result of the comparison by the comparison unit.

18. The print control apparatus according to claim 7, further comprising:

a storage unit configured to store a page number associated with a page whose print quality is determined not to satisfy the predetermined criterion, wherein the counting unit is configured to count the number of the first pages determined not to satisfy the predetermined criterion, based on the page number stored by the storage unit, and count the number of the second pages determined not to satisfy the predetermined criterion, based on the page number stored by the storage unit.

* * * * *